US006558220B1

(12) United States Patent
Kadoshima

(10) Patent No.: US 6,558,220 B1
(45) Date of Patent: May 6, 2003

(54) BUBBLE MAKING DEVICE WITH A VARIABLE SIZE COLLAPSIBLE LOOP

(76) Inventor: Donald Y. Kadoshima, 19713 - SE. 261st St., Kent, WA (US) 98042

( * ) Notice: Subject to any disclaimer, the term of this patent is extended or adjusted under 35 U.S.C. 154(b) by 0 days.

(21) Appl. No.: 09/444,171

(22) Filed: Nov. 19, 1999

(51) Int. Cl.[7] ..... A63H 33/28

(52) U.S. Cl. ..... 446/15; 446/16; 446/18; 446/21

(58) Field of Search ..... 446/15, 16, 17, 446/18, 19, 20, 21

(56) References Cited

U.S. PATENT DOCUMENTS

| | | | | | |
|---|---|---|---|---|---|
| 4,654,017 | A | | 3/1987 | Stein | 446/15 |
| 4,790,787 | A | | 12/1988 | Rector | 446/15 |
| 4,943,255 | A | | 7/1990 | Klundt | 446/15 |
| 5,002,512 | A | | 3/1991 | Stein | 446/15 |
| 5,224,892 | A | | 7/1993 | Messina | 446/15 |
| 5,334,087 | A | | 8/1994 | Messina | 446/15 |
| 6,059,629 | A | * | 5/2000 | Lin | 446/15 |

OTHER PUBLICATIONS

"Professor Bubble'Official Bubble Handbook", Faverty, Richard, Greenleaf Publishers, 1987, p. 34.

* cited by examiner

*Primary Examiner*—Derris H. Banks
*Assistant Examiner*—Ali Abdelwahed
(74) *Attorney, Agent, or Firm*—R. Reams Goodloe, Jr.

(57) ABSTRACT

A bubble making apparatus. The apparatus is a manually workable device having a pair of open limbs joined at a junction. A V-shaped wand, with a pair of limbs that are joined at a normally open angle alpha in a spring like, or alternately a pivotable fashion. Upon manual compression, the limbs are urged apart to a pre-selected angle. A flexible, absorbent cord is affixed at locations on each of the limbs. The flexible cord is brought together to form a bubble-making loop. A portion of the flexible cord is located to enable the user to vary the size of the bubble-making loop. The flexible and collapsible nature of the loop permits use of a long narrow container for bubble solution, which requires less bubble-making solution than a rigid wand of comparable effective diameter. This collapsible feature also facilitates the creation of and the "closing-off" of large bubbles.

40 Claims, 10 Drawing Sheets

BUBBLE MAKING DEVICE WITH A VARIABLE SIZE COLLAPSIBLE LOOP

TECHNICAL FIELD

This invention generally relates to devices for making bubbles, and more particularly, to devices for manually making bubbles of moderate to large diameter.

BACKGROUND

Soap bubbles have been made with pipes and tubes of various types, with hoops of various shapes and of various sizes, and using various materials of construction. Indeed, some relatively complex mechanical devices have been developed heretofore for the purpose of making bubbles.

It is well known and understood that bubbles can be made with simple loops of string or wire. In fact bubbles can be made with almost any completely wettable continuous loop of reasonable size and shape. In an even more basic fashion, bubbles can be made using the "O" which is formed by bringing one's thumb and index finger together.

A bubble exists because of the properties of the thin film that forms the envelope for the bubble. This film tends to minimize its overall surface area, and consequently, bubbles tend to become spherical. This is a very complex phenomenon, but is fundamentally determined by the nature of the chemical constituents in the bubble solution that determine the surface tension of the bubble film, the size of the bubble, and interestingly and very significantly, the specific local weather conditions.

The surface area of a sphere is directly proportional to the square of its diameter. Thus, a 30-inch diameter bubble has about 100 times the surface area of a 3-inch diameter bubble. So, assuming approximately the same film thickness, the 30-inch diameter bubble uses about 100 times the quantity of bubble solution, per bubble. Such comparisons are even more significant when large diameter bubbles are being developed. For example, an 8 foot diameter bubble requires about 1000 times more bubble solution than the 3 inch diameter bubble.

Under ideal conditions, large bubbles can be made with a simple solution of water and soap, or detergent, but conditions are seldom ideal. Therefore, to generate large and long lasting bubbles for a variety of common outdoor conditions requires that bubble solutions include various enhancing additives. A principal component of such solutions is glycerin. Often, other "secret" ingredients are included in bubble solutions, including constituents such as corn syrup, gelatin, fruit pectin, or other substances. It is of interest with respect to the apparatus and method of the present invention that professional bubble exhibitors generally perform indoors, and vigorously attempt to control the ambient temperature, relative humidity, and minimize air movement and velocity, even when using complex, stability enhancing bubble solutions.

Many commercial firms market aqueous solutions for making bubbles. It is the surface tension properties of the solution that causes drops of the solution to form, because the surface tension tends to minimize surface area. The greater the surface tension, the more spherical the drop. A bubble cannot form, and/or the bubble film bursts before a complete bubble can be formed, should the surface tension overcome the tensile strength of the bubble film. Therefore, it can be appreciated that a bubble forms from a liquid of low surface tension properties. The surface tension of the liquid within the bubble film inherently tends to minimize the bubble's surface area, so bubbles tend to be spherical. However, large bubbles cannot be made using the tiny hoops provided with the commercially available bubble-making solutions that are presently known to me, because as the bubble film tends to minimize its surface area, the bubbles made using the small loops naturally "close off" the elongated solution film into bubbles no larger than, but usually much smaller than, about 3½ times the diameter of the loop used to make the bubble. With such devices, no conscious effort is required by the user to "close off" the bubbles. Unfortunately, this same property of the bubble film solution also precludes the making of large bubbles with relatively small hoops.

The size and persistence of a bubble is very dependent on the size of a loop used to make the bubble, the nature of the loop, the chemical composition of the bubble solution, the amount and velocity of the air that extends the solution film, and the prevailing environmental conditions. Generally, when (i) the loop, (ii) the composition of the bubble solution, and (iii) the weather conditions are identical, larger bubbles are harder to make and do not usually persist as long as smaller bubbles. At the present time, no commercially available product, hoop, or bubble solution, is known to me to be available specifically to make the very large (and often "gigantic") bubbles within the usual summer outdoor "bubble-making time of the year" conditions.

Most conventional, commercially available hoops are of a rigid nature and circular in design. Since the size of the hoop generally fixes the upper size limit of the bubble, large diameter hoops (say from about 1 foot in diameter up to 3 feet in diameter) are required to make the large to very large diameter bubbles (say from about 3 foot diameter to about 8 feet in diameter). In order to utilize such prior art hoops, a sizable container, sized at least slightly larger than the diameter of the hoop, is a necessity, simply to be able to dip the hoop into the bubble solution. Such large containers are also undesirable from the standpoint of providing sufficient bubble solution. For example, in order to fill a 3 foot diameter container (positioned perfectly level) to a depth of only 1 inch requires almost four and a half gallons (actually, 4.41 gallons) of liquid. Although the needs of smaller circular hoops are proportionally reduced, a circular container for only a 12-inch diameter hoop still requires about ½ gallon of bubble-making solution. Thus, it can be seen that it would be desirable to provide a bubble-making apparatus that avoids the necessity for large diameter containers to be utilized.

Another aspect of making large bubbles which must be appreciated is that large bubbles cannot be blown from a large hoop using one's own breath, for human lungs are simply not large enough. A large bubble-making hoop must be moved through the air, or the wind must be allowed to blow through it. Large hoops also present other challenges. Importantly, the movement through the air of large sized hoops, and even moderate sized hoops, must fundamentally be gentle, or the bubble solution film situated within the hoop will burst, preventing the formation of a bubble. Also, the bubble-making motion cannot be just a continuous motion, but must include the act of "closing-off" the bubble, which is often accomplished only with an intricate twist of the hoop, and/or a quick change of direction. In the event such a "close-off" is not accomplished, one normally ends up just making a long bubble tube of approximately the diameter of the hoop, which usually soon bursts. However, a "close-off" for making the bubble is not generally an easy maneuver to master when using large, rigid, and particularly circular type hoops. This is in marked contrast to small sized hoops that easily make small bubbles, because the properties of the bubble solution film intrinsically "close-off" the bubble before a long bubble tube can develop. Consequently, using prior art devices, it is generally quite difficult, if not virtually impossible, to form long bubble tubes when using small diameter hoops.

Importantly, a good technique to form moderate to large bubbles involves forming and closing the bubble with a generally upwards motion that literally "throws" such bubbles upwards, often allowing it to catch the wind, and so it can persist longer before it comes in contact with the ground. It is easy to visualize that large bubbles formed without using such technique will usually sink quickly to the ground, because it is relatively heavy compared to the air in which it has been formed. On the other hand, small bubbles are essentially of negligible mass, and cannot be "thrown", and thus are at the mercy of air currents from their inception.

With conventional bubble-making devices known to me, drawing a large-rigid-circular hoop out of a container of bubble solution with the bubble-forming solution film intact requires a very exacting, slow twisting motion. Otherwise, the bubble-forming film breaks. Generally, with such prior art devices, the greater the depth of the bubble solution in a container, the more successful a user will be in maintaining the bubble-forming solution film when drawing a rigid hoop from a bubble solution. Also, it is easier to draw a rigid hoop out of a container of bubble solution in a substantially edgewise fashion, that is, along the plane formed by the hoop orientation. So, smaller rigid hoops are easier to withdraw from a particular depth of bubble solution while keeping the bubble solution film intact.

Since larger diameter bubbles have greater surface areas, such bubbles require bubble solutions that provide greater bubble film thickness, and/or slower rates of evaporation of the bubble film solution, in order for such bubbles to persist with relatively long-life. Gravity also acts on the thin liquid film that forms a bubble, and tends to draw the bubble solution within the thin film towards the bottom of the bubble, thus thinning the bubble film near the top of the bubble, and increasing the bubble film thickness near the bottom of the bubble. The greater film thickness at the bottom is at the expense of the film thickness at the top, as the constant air pressure within the bubble essentially maintains the same internal volume. The uneven thickness of the bubble film naturally upsets the surface tension equilibrium about the bubble, thus reducing the resiliency of the bubble film when subjected to even slight stresses.

The top of the bubble is also the location where the greatest evaporation usually takes place, particularly in sunlight. Resultantly, even relatively low stresses will cause the bubble to burst. It is therefore difficult, and sometimes impossible, to make large bubbles during hot, dry days if the wind is gusting, and/or blowing faster than a gentle breeze. Further, it has historically been difficult to develop large bubbles that persist for as long of a time as small bubbles during good summer outdoor conditions, even with custom made "super" bubble-making solutions.

Many commercially available bubble-making solutions reach a good compromise between the cost, bubble size limitations, and persistence of the bubbles, but noticeable differences exists between different brands. The principal ingredients that provide the most desirable characteristics are also the most expensive ingredients in the bubble solution. So, the "best" bubble solutions contain greater proportions of glycerin, but are also the most costly to manufacture. Therefore, the manufacturing and/or procurement cost for the bubble-making solution becomes a very important consideration when thinking about making great big bubbles.

Another important factor that complicates bubble-making is the contamination of the bubble-making solution during use. Contaminated bubble solutions do not produce big, and/or long lasting bubbles. Unfortunately, when used outdoors, the large diameter open containers necessary for using large diameter hoops invite all sorts of foreign material to enter such containers and pollute the bubble solution. Even the surface foam produced by agitation of the bubble-making solution can adversely affect the qualities of the bubble. Large circular containers also make it difficult to salvage the unused bubble solution, that is, they make it difficult to pour even uncontaminated bubble-making liquids into a storage container after the bubble-making session is over. In summary, the necessity to use large diameter containers for bubble-making presents many inherent disadvantages, and can have a negative effect on the enjoyment of "blowing big bubbles".

Many inventors have recognized the shortcomings of moderate to large-rigid-circular hoops, and thus have attempted to develop workable devices to overcome some or all of the above-described limitations.

U.S. Pat. No. 5,334,087 issued to G. A. Messina in 1993 concerns a bubble solution pumping-dispensing-collection system, and a mechanism to support, expand, and collapse a flexible/elastic-band loop. In that design, the collapse of the loop must be complete, that is, the flexible bands must come within very close proximity to each other. Otherwise, the bubble solution will not create the necessary bubble solution film between the bands, from which the bubble forms. Also, with that device, it appears the user cannot 'throw' the bubble upwards. Such a device would also be awkward to swing through the air in any orientation; indeed, the patent states that air movement forms the bubble. So it appears that much of the success of bubble-making depends on the properties of the wind, which is unfortunately not under the direct control of the user.

U.S. Pat. No. 5,224,892 issued to G. A. Messina in 1991 concerns a bubble solution pumping-dispensing-collection system. This invention appears to suffer many of the same shortcomings as the invention described in U.S. Pat. No. 5,334,087.

U.S. Pat. No. 5,002,512 issued to D. V. Stein in 1988 primarily concerns a somewhat triangular, 3-sided loop, which according to the inventor, requires the use of both hands to manipulate correctly. The primary apparatus utilizes a weight attached to the bottom of a flexible line to create the loop form. The orientation of the loop is not truly independent of the speed, and/or direction of the swing, but is dictated by inertial, centrifugal, and momentum factors, and so requires the user to make the proper-coordinated-motion adjustments of both arms in different wind conditions to successfully form, and "close off" large bubbles, and/or "throw" the bubble upwards. Also, the size of the loop of the primary apparatus does not appear to be readily adjustable.

U.S. Pat. No. 4,943,255 issued to K. K. Klundt in 1987 utilizes a loop attached at the extremity of 2 separate wands. This device also employs a weight attached to a flexible loop, thus suffers the same fundamental shortcomings of the apparatus described in Stein's U.S. Pat. No. 5,002,512.

U.S. Pat. No. 4,790,787 issued to D. V. Rector in 1986 concerns a loop comprised of 2 semi-rigid bow members. This device requires the use of both hands to expand the loop, or to collapse the loop. Also, the peripheral size of the loop is not adjustable.

U.S. Pat. No. 4,654,017 issued to D. V. Stein in 1985 shows a single sliding attachment point for a loop on a single rod. A weight positioned at the bottom of a line is used to completely form the loop. So, this apparatus presents the same difficulties as found in the previous Stein patent and in the Klundt patent.

While some of the noted prior art devices permit the use of a bubble solution container smaller than would be necessary if a rigid circular hoop of the same effective diameter were utilized, such prior art devices do not permit the user to actually control the plane of the bubble-making loop during the whole of the process of bubble formation. Moreover, such devices do not allow the user to independently determine both the speed and direction of a bubble-making loop, at various stages during the process of forming, "closing off", and throwing the bubble upwards. Finally, such prior art devices would be difficult, if not impossible, to use with only one hand.

OBJECTS, ADVANTAGES, AND NOVEL FEATURES

One important object of my invention is to enable younger, and/or smaller children to readily make bubbles of at least moderate diameter, say in the 6-inch to 12-inch range.

It is an important advantage of my invention that such devices can be utilized with either (a) a small loop size, or (b) with a large loop size, and that the loop size is readily adjustable.

It is a feature that adjustable, interchangeable loop sizes permits use of my bubble-making devices by small children, yet allows a more capable user, that is, older children, and/or their parents or others, to quickly make many larger diameter bubbles.

It is yet another important advantage that certain embodiments of my novel bubble-making apparatus can be easily manipulated and fully utilized when using only one hand.

It is a feature of the invention that a large number of bubbles can be readily and quickly made, thus allowing users to each generate a great number of moderate size to large size bubbles (or fewer gigantic bubbles), and therefore can have a plurality of bubbles in the air all at the same time.

An important and related objective of my invention is to enable bubble-making to be transformed from "boring kid's play" into the realm of real, serious, "big person's fun".

Another important object of some embodiments of the invention is to provide a manually compressible (squeezeable) wand that allows a supple, compliant, bubble-forming loop portion to collapse, so that the loop portion can be dipped into a narrow bubble-making solution container.

It is an advantage that many embodiments of my bubble-making device can be utilized with a bubble solution container of the size of only about 4 inches in width and a preselected length corresponding to a maximum dimension of a bubble-making loop portion of a specific device.

It is an important feature of my invention that the minimum quantity of bubble solution required for a narrow container may be as small as about 1 pint, or about one-fourth of the quantity of bubble-making solution required for a prior art 12-inch diameter rigid circular hoop to generate bubbles of comparable size.

Yet another feature of my bubble-making devices are that they provide an easy method of "closing off" a bubble tube being formed to finally provide a large bubble; this is achieved by simply squeezing the opposing limbs of the bubble-making device together (preferably still using only one hand).

It is a related and important feature of some embodiments of the invention that the ability to close off a bubble with a single hand enables the user to quickly make and throw large bubbles upwards.

A still further and important feature that my apparatus provides is the ability to purposefully impart "spin" to the bubbles being formed, thus reducing the tendency of such bubbles to thin-out at any specific region due to gravity acting on the bubble. This is an important advantage, since the spinning action of a bubble can minimize the thinning of bubble walls and greatly prolong the lifetime of a bubble, compared to a bubble of similar size that has little or no rotational motion. This minimizes the detrimental effect of gravity on a bubble.

Yet another important feature of my bubble-making devices are that they can be easily withdrawn from a bubble solution with bubble-making film intact when the limbs of the device are squeezed together, with the bubble-forming loop portion in a collapsed form. This is possible since the bubble film minimizes its surface area by connecting between the smallest area defined between the opposing portions of the collapsed loop, to provide a bubble film completely extending between the U-shaped members of the collapsed loop, or smaller separated sections of the loop portion as they occur. This feature is an important advantage for very young users, since with prior art devices, they usually find it difficult to retain a bubble-making solution film intact even when using moderate (about 6-inch) diameter rigid hoops. Thus, the present invention opens up large diameter bubble-making to younger children.

Still another important advantage of my bubble-making device is that it enables utilization of a narrow width bubble solution container, and thus significantly reduces the potential for contamination of the bubble solution, when compared to prior art devices. Also, narrow width bubble solution containers facilitate recovery of unused bubble solution back into a storage container when through for the day. This is important since the cost of "good" bubble solutions (whether "home brewed", or commercial) usually required for large bubbles is usually significantly higher than the cost of bubble-making solution of sufficient quality for small bubbles. Thus, a reduced quantity of bubble-making solution for making big bubbles, and the ability to salvage the unused portion, is an important advantage in the making of great big bubbles. The device provided herein enables a user to easily maintain bubble solution purity, and to salvage unused bubble solution, and is an important component of enhancing the enjoyment, since it significantly reduces costs involved in making large diameter bubbles.

Still another object of my invention is to provide to the user of my device a means to make very large to gigantic bubbles (say six (6) or more feet in diameter), when using the appropriate embodiment of my invention, with a rather nominal quantity of the proper bubble solution, while avoiding the necessity to buy large quantities of such expensive "best of the best" bubble solution.

Other important and more specific objects, advantages, and novel features of the invention will become apparent to the reader from the foregoing and from the appended claims, as well as from the ensuing detailed description and discussion which proceeds in conjunction with the accompanying drawing.

BRIEF DESCRIPTION OF THE DRAWING

The invention may be better understood by reference to the drawing, wherein.

Figure 5:
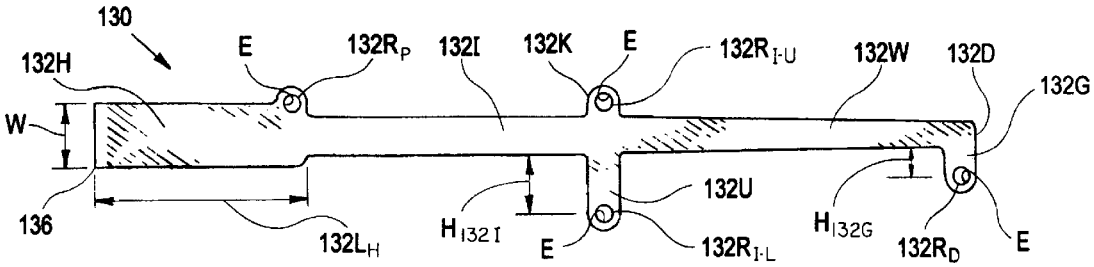

Other embodiments of my bubble-making apparatus are illustrated, wherein:

FIG. 5 is a side elevation view of a first limb of a second embodiment of the bubble-making apparatus, showing a unitary, preferably limb configuration, such as may be utilized when the apparatus is manufactured by injection molding of plastic material to form a molded plastic bubble-making wand.

Figure 6:
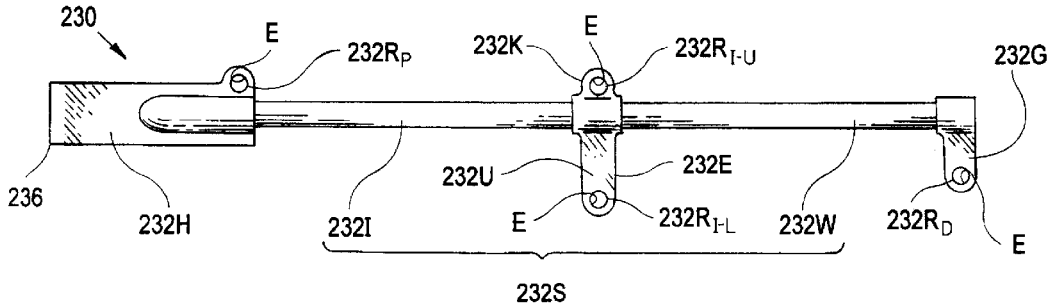

FIG. 6 is a side elevation view of a first limb of a third embodiment of my bubble-making device, a limb that is configured from assembly of various component parts.

Figure 7:
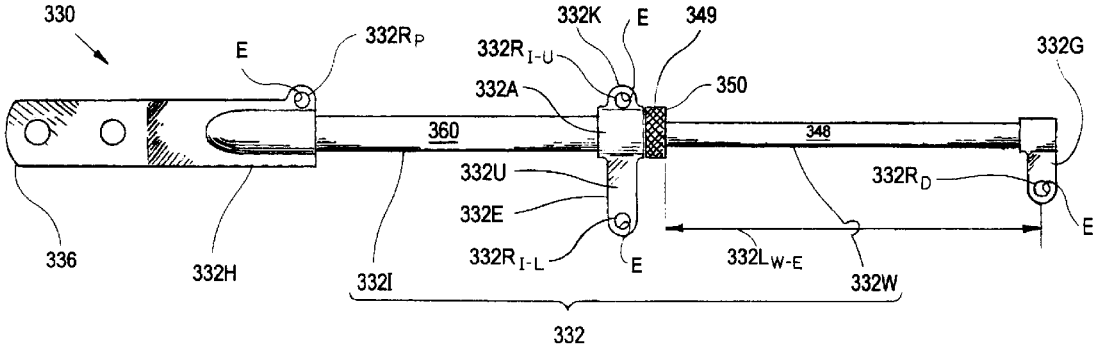

FIG. 7 is a side elevation view of a fourth embodiment of my bubble-making device, illustrating a telescopic limb subassembly in an extended configuration; such telescopic limb may be utilized to vary the distance between the attachment places of a bubble-forming loop (and also allows the device to be collapsed for transport and storage).

Figure 8:
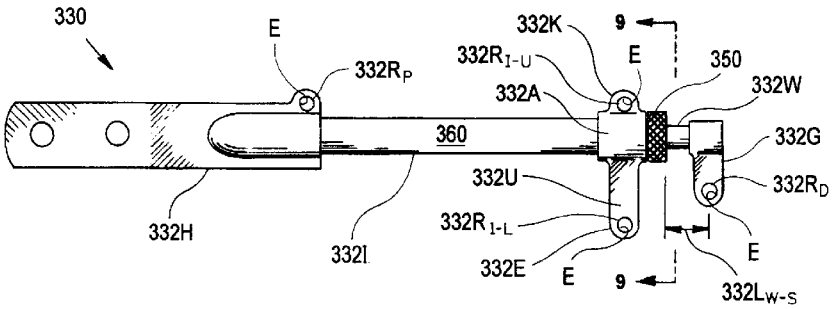

FIG. 8 is a side elevation view of the embodiment just illustrated in FIG. 7, now showing the telescoping limb in a collapsed configuration for transport or storage.

Figure 9:
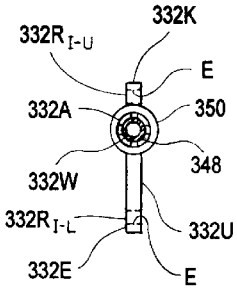

FIG. 9 is a vertical cross-sectional view, taken across line 9—9 of FIG. 8, showing the tubular construction of the telescoping limb just illustrated in FIGS. 7 and 8.

Figure 10:
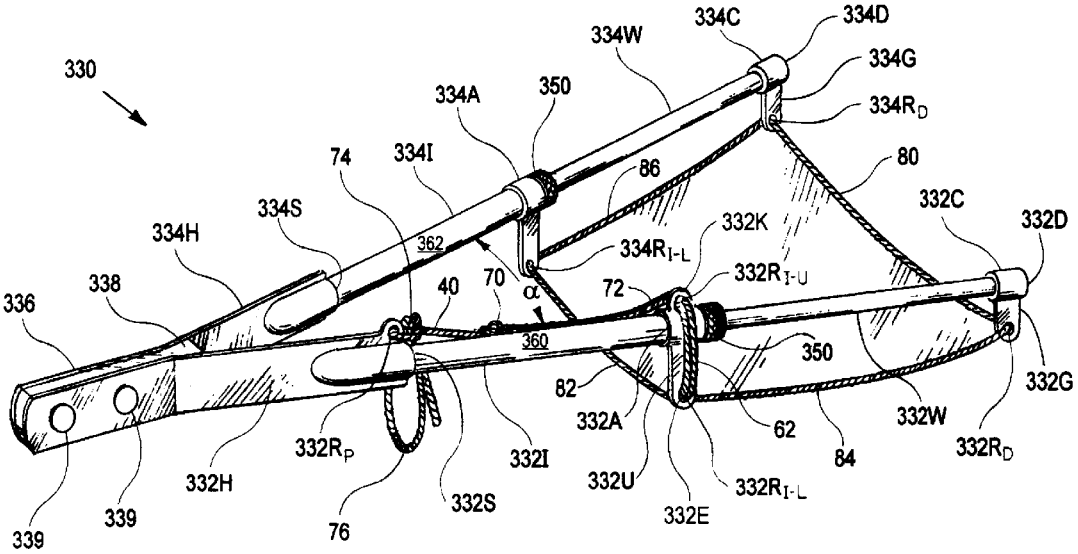

FIG. 10 is a perspective view of the embodiment just illustrated in FIGS. 7, 8 and 9, now showing the telescoping limbs in their extended, operating position, and with a wetted loop forming cord having suspended thereby a thin, generally trapezoidal shaped bubble-forming film.

Figure 11:
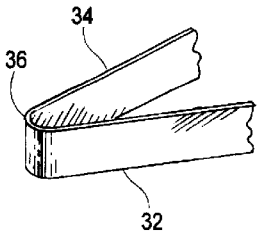
Figure 12:
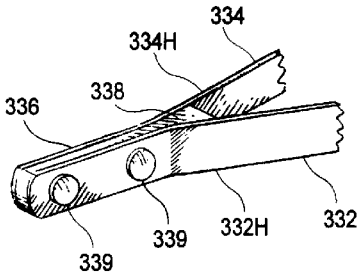
Figure 13:
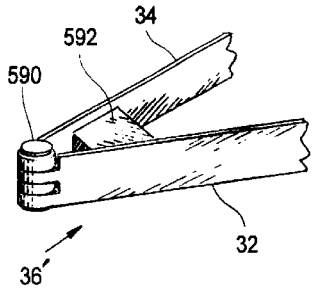

FIGS. 11, 12, and 13 illustrate three different embodiments which may be utilized for joining a first limb and a second limb in most of my bubble-making devices in (a) a resilient, easily single-handed manually compressible closed fashion, but (b) in a normally open, spread apart relationship.

First, in FIG. 11, inherent spring action between a first limb and a second limb is achieved, such as by use of spring steel or other resilient material which elastically returns to a pre-displacement position.

Second, in FIG. 12, a resilient, compressible, but normally expanded material is placed between the first and second limbs.

Third, in FIG. 13, a hinged joint is provided, but a resilient, compressible, but normally expanded material is retained between the first and second limbs.

Figure 14:
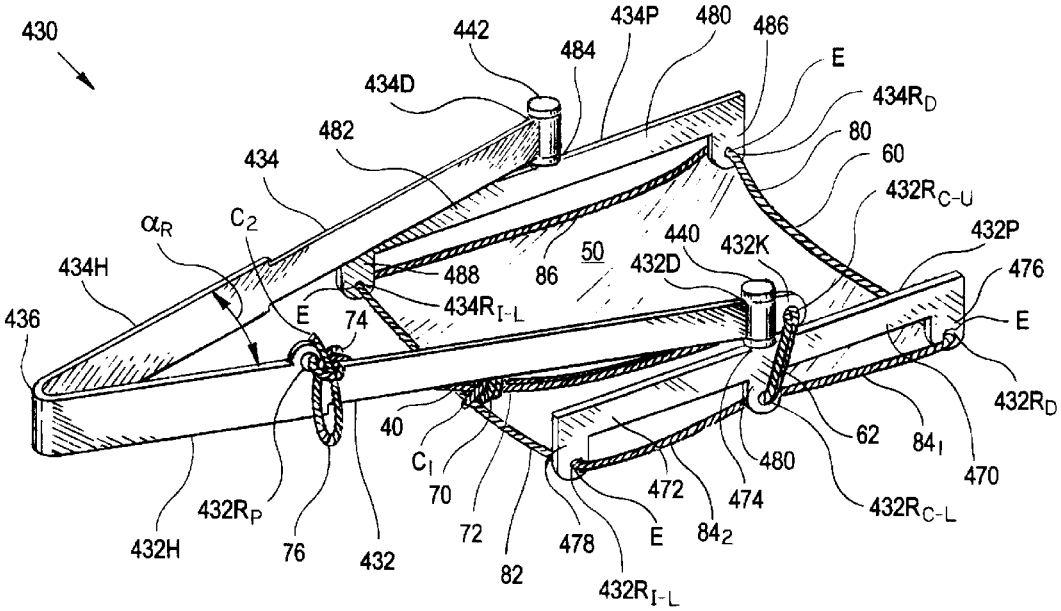

FIG. 14 is perspective view of a fifth embodiment of my bubble-making device, now showing use of an arm pivotally attached at or near the distal end of the first and second limbs of the device.

Figure 15:
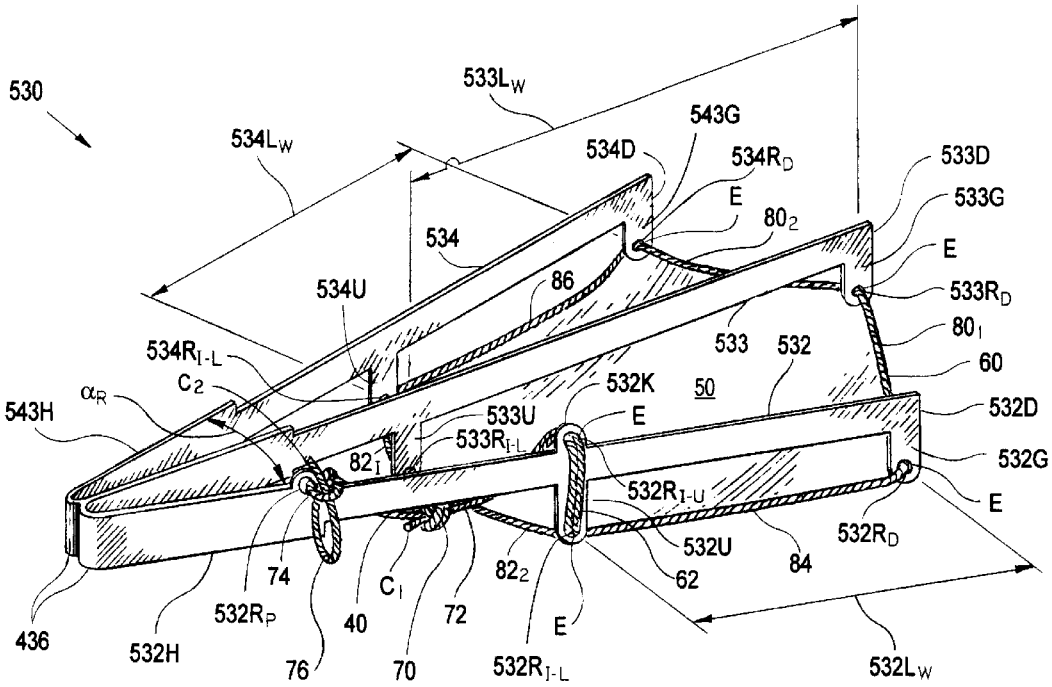

FIG. 15 is a perspective view of a sixth embodiment of my bubble-making device, showing a design wherein more than two limbs are provided to spread a wettable cord used to form a bubble-making film; here, three limbs are provided for spreading a wettable cord into a hexagonal shape.

Figure 16:
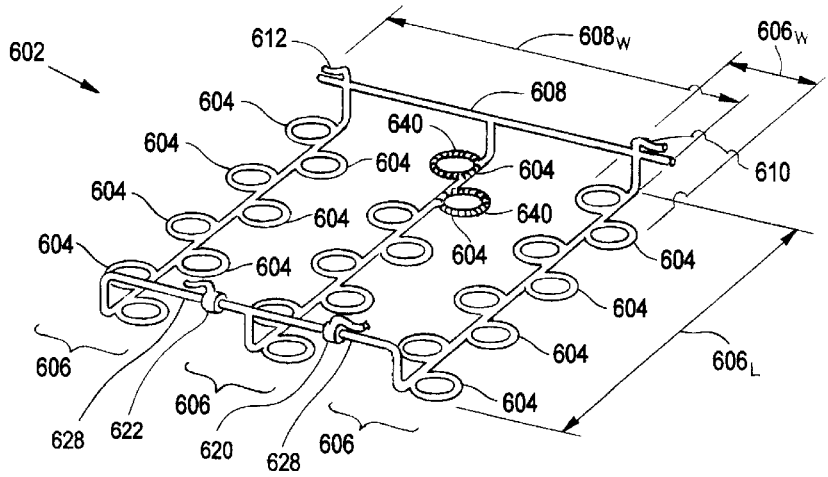

FIG. 16 is a perspective view of a bubble-making frame having a plurality of segments, with each segment providing a plurality of bubble-making and preferably rigid hoops.

Figure 17:
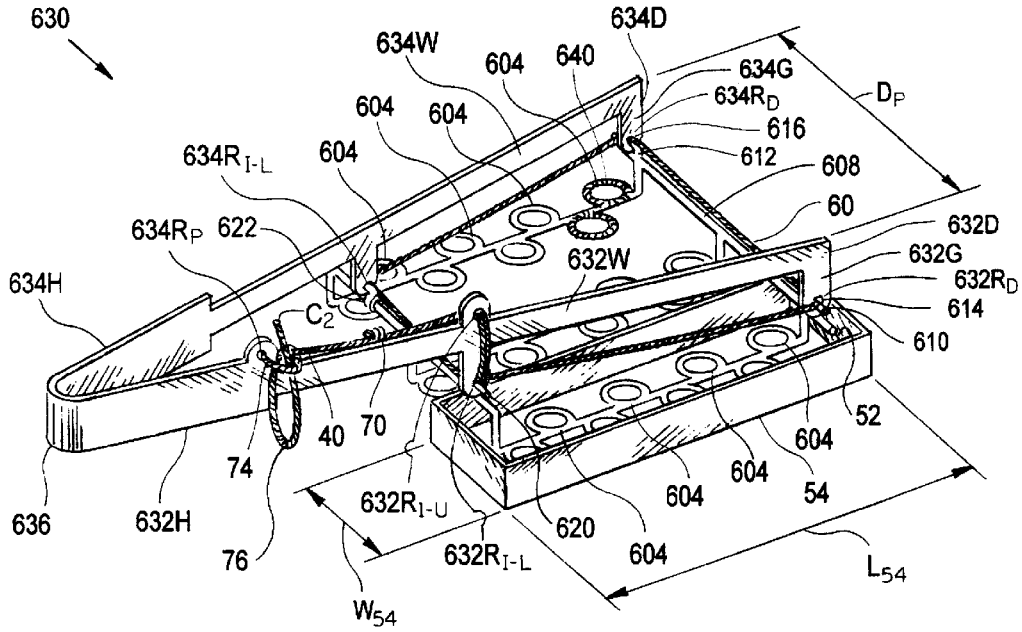

FIG. 17 is a perspective view of a seventh embodiment of my bubble-making device, showing a design wherein the bubble-making frame just described in FIG. 16 is attached between opposing limbs of my device, for use in dipping each segment and the associated group of small hoops into a long, narrow bubble solution container.

Figure 18:
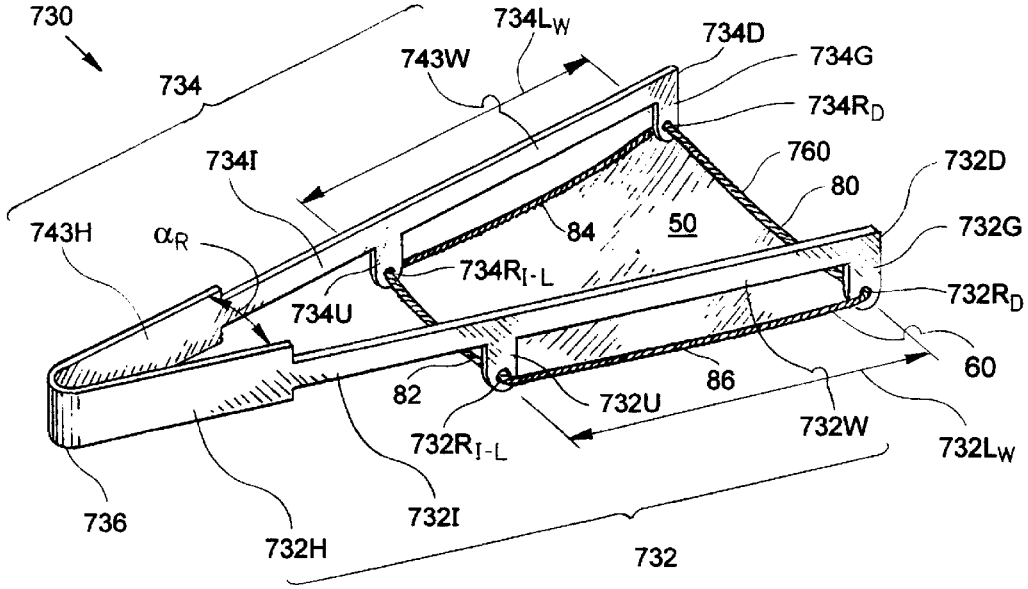

FIG. 18 is a perspective view of an eighth embodiment of my bubble-making device, now showing use of a generally V-shaped frame with a collapsible pair of opposing limb members, and having attached thereto a wettable cord with a fixed size collapsible loop to provide a bubble-making film, as illustrated.

Figure 19:
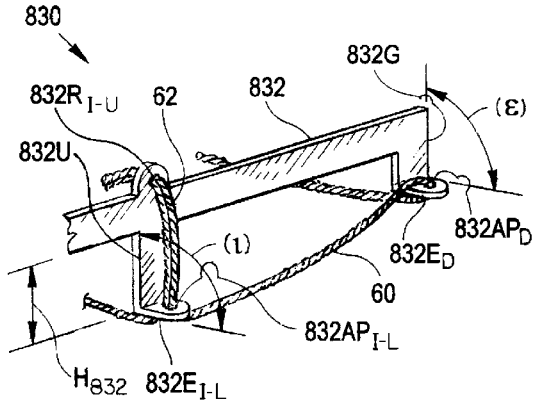

FIG. 19 is a partial perspective view of the first limb of another embodiment and shows the first distal attachment location and first lower intermediate attachment location each oriented in a different plane relative to their respective offset legs.

Figure 20:
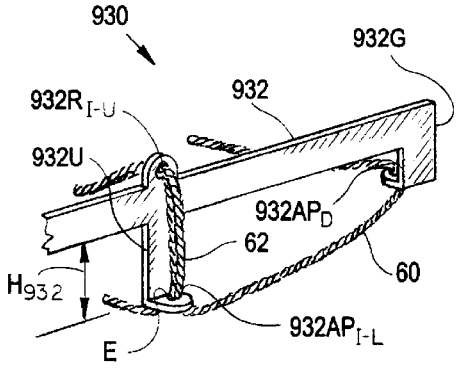

FIG. 20 is a partial perspective view of the first limb of still another embodiment and shows the first distal attachment location and the first lower intermediate attachment location oriented in opposing planes, each different than the plane of their respective offset legs.

Figure 21:
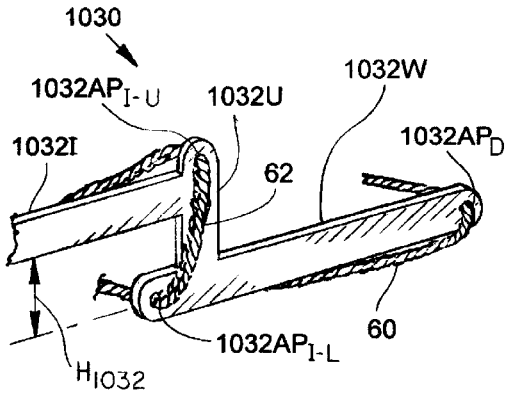

FIG. 21 is a partial perspective view of the first limb of still another embodiment and shows the first distal attachment location and first lower intermediate attachment location near opposing ends of an extended downwardly offset working portion of the first limb.

Figure 22:
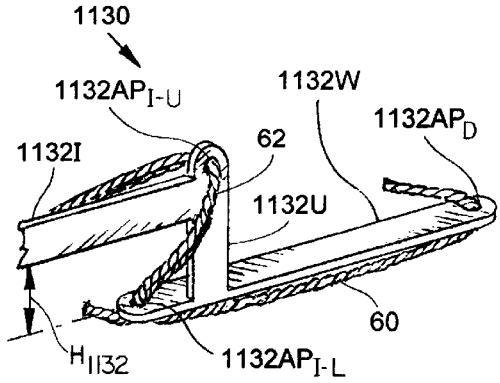

FIG. 22 is a partial perspective view of the first limb of still another embodiment and shows the distal attachment location and lower intermediate attachment location at opposing ends of the downwardly offset working portion of the first limb, with the downwardly offset working portion and accompanying aforementioned attachment portions oriented in a different plane from the downwardly offset leg, with the embodiments shown here offset by ninety degrees (90°).

Figure 23:
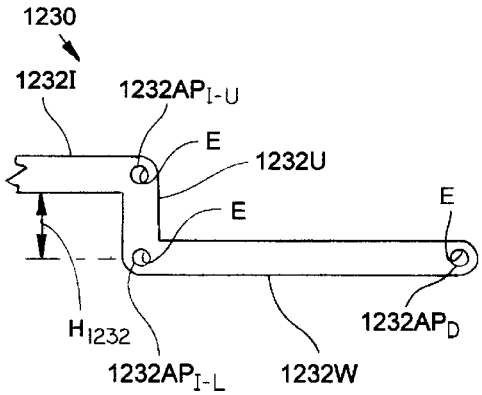

FIG. 23 shows the distal attachment location and lower intermediate attachment location within a downwardly offset working portion of the first limb.

Figure 24:
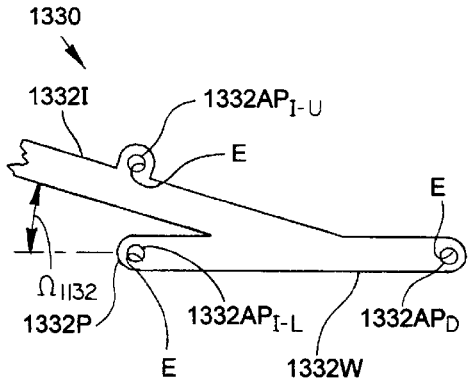

FIG. 24 illustrates another embodiment where the first working portion, with its associated distal attachment location and lower intermediate attachment location, is positioned at an angle to the remainder of the first limb.

Figure 25:
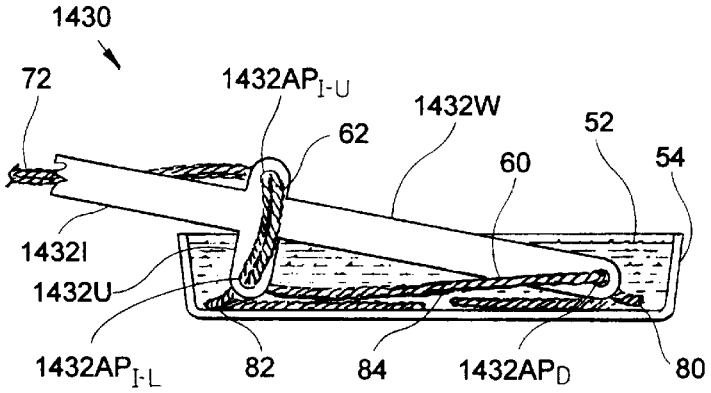

FIG. 25 is a partial sectional view, showing a distal attachment location near the distal end a first limb, with a lower intermediate attachment location offset downward by a first downward leg, all positioned in bubble solution in a bubble solution container.

Figure 26:
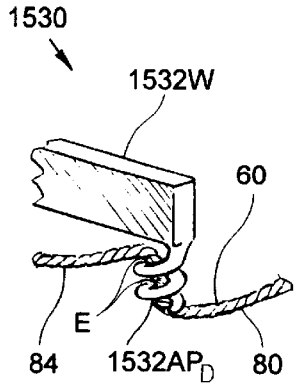

FIGS. 26 though 32 illustrate a few alternative structures within the broad teachings herein for performing a loop securing function at attachment locations of the bubble-forming loop.

FIG. 26 illustrates use of a spiral, helical structure having one or more loops (two shown) for capture of the bubble-forming loop.

Figure 27:
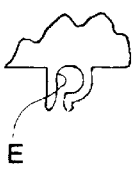

FIG. 27 illustrates use of an open-ended, preferably vertically oriented, downwardly opening "P-shaped" clamp for capture of the bubble-forming loop.

Figure 28:
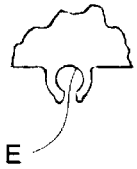

FIG. 28 illustrates use of an open-ended "C-shaped" clamp for capture of the bubble-forming loop.

Figure 29:
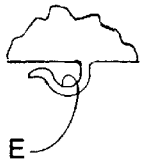

FIG. 29 illustrates the use of an open-ended, preferably horizontally oriented "P-shaped" clamp for capture of the bubble-forming loop.

Figure 30:
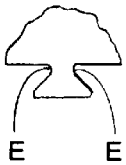

FIG. 30 illustrates the use of a downwardly oriented triangular generally arrowhead shaped structure for capture of the bubble-forming loop.

Figure 31:
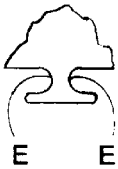

FIG. 31 illustrates the use of a downwardly oriented, generally inverted T-shaped structure for capture of the bubble-forming loop.

Figure 32:
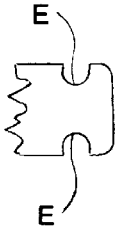

FIG. 32 illustrates the use of a vertically opposing U-shaped cut-out structure for capture of the bubble-forming loop.

Figure 33:
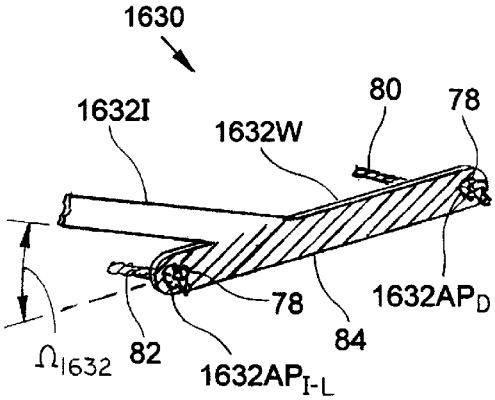

FIG. 33 is a partial perspective view of a first limb of a bubble-making wand wherein the size of the loop is fixed, and shows the working portion of the first limb is at an angle to the remainder of the limb, with separate cords making up the distal and proximal portions of the bubble-forming loop.

Figure 34:
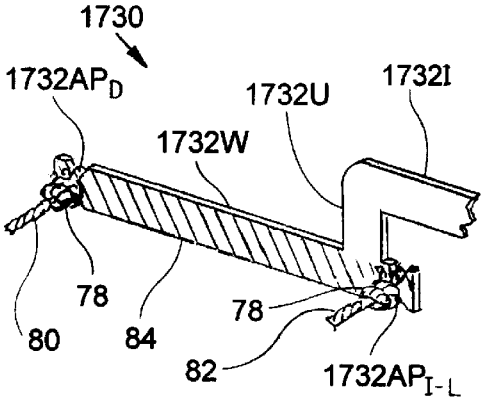

FIG. 34 is a partial view of another embodiment of a fixed size loop bubble-making device, shown utilizing the cut-out structures first illustrated in FIG. 32 above, as attachment locations for the bubble-forming loop.

Figure 35:
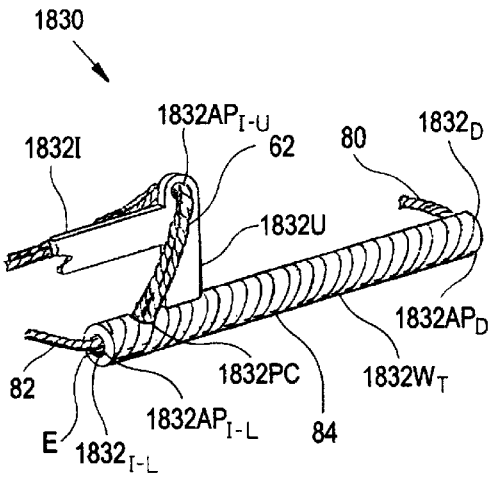

FIG. 35 shows a working portion of a first limb having a tubular structure, through which a flexible absorbent cord is passed to provide a portion of a bubble-forming loop.

Figure 36:
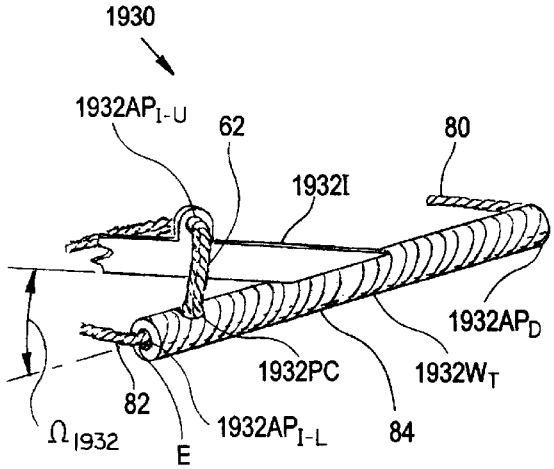

FIG. 36 shows a tubular working portion structure as shown in FIG. 35, but with the remainder of the first limb positioned at an angle relative to the tubular working portion.

FIGS. 37 through 42 show steps in a method of creating bubbles when using some embodiments of my bubble-forming devices.

Figure 37:
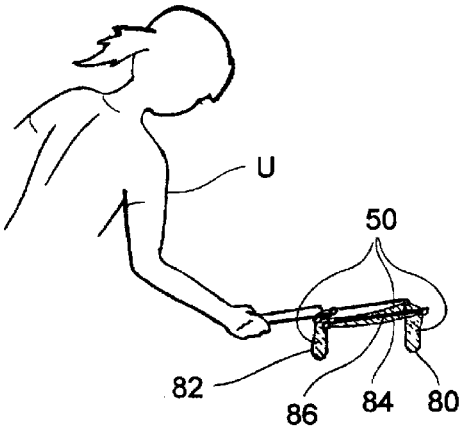

First, FIG. 37 shows a pair of collapsed limbs, with a bubble film forming loop suspended therebelow, and with a bubble-making film provided on the wetted cord, as if just removed from a container of bubble-making solution.

Figure 38:
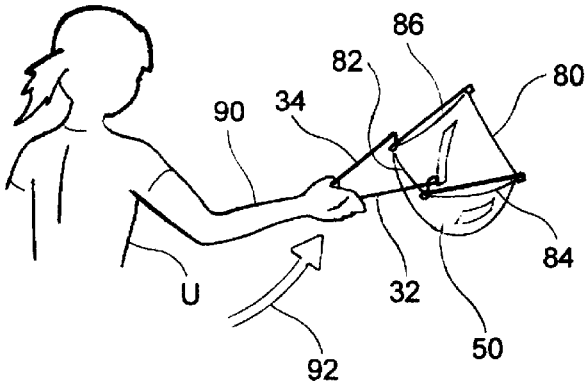

Then, FIG. 38 shows the user allowing the collapsed first and second limbs to gradually spread apart, while gently swinging the device upwards to allow a generally trapezoidal bubble-forming film within the loop forming wetted cord to begin the bubble-forming process.

Figure 39:
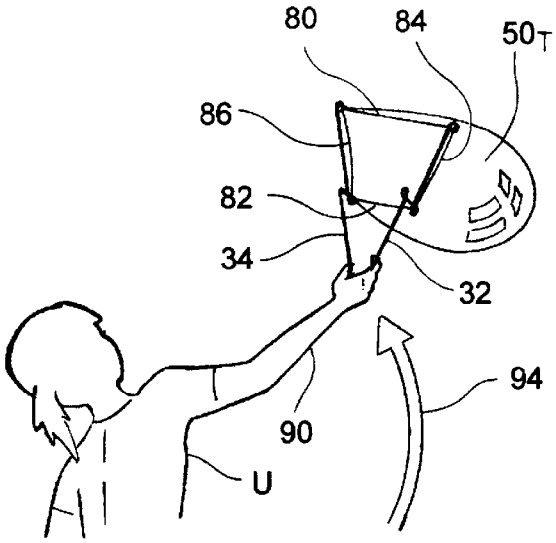

Next, FIG. 39 shows the user continuing the swinging of the bubble-forming loop upward in a large arc, to expand the bubble-forming film into an elongated, somewhat tubular bubble shape.

Figure 40:
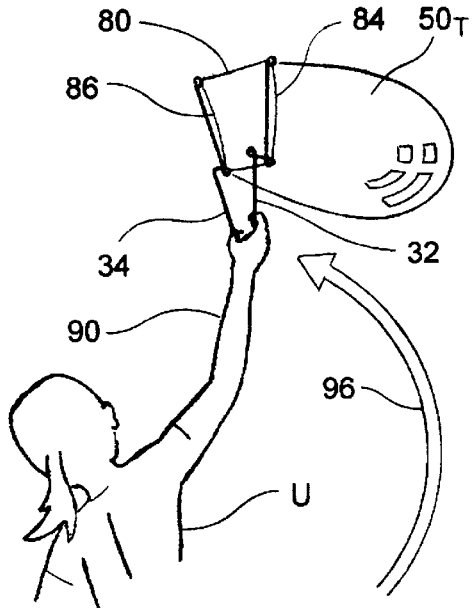

Then, in FIG. 40, while the user continues the swing, the upward swing, the user begins to collapse the opposing limbs, to close off the end of the elongated tubular bubble shape.

Figure 41:
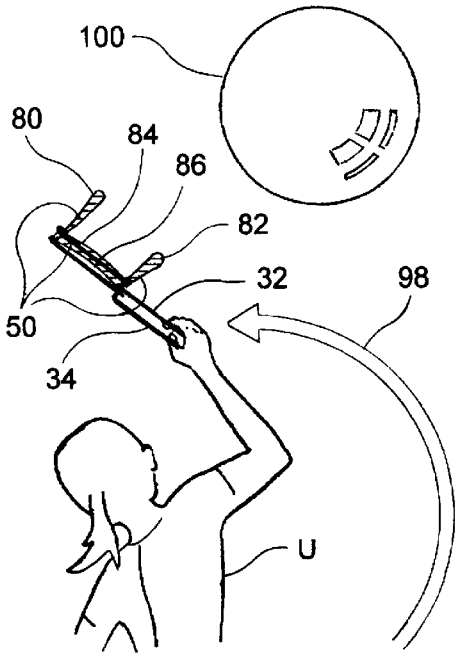

In FIG. 41, the user has completely collapsed the opposing limbs of the bubble-forming device, to release the spinning bubble upwards.

Figure 42:
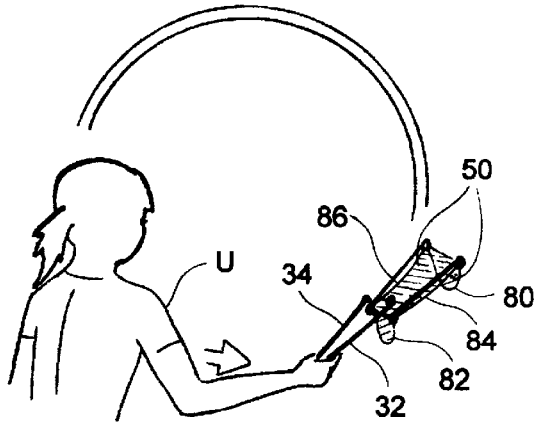

FIG. 42 further illustrates use of an overall rotary or circular motion, wherein having been completed for one bubble, the user is able to immediately repeat the upwardly directed wand opening process to create another bubble.

DESCRIPTION

Figure 1:
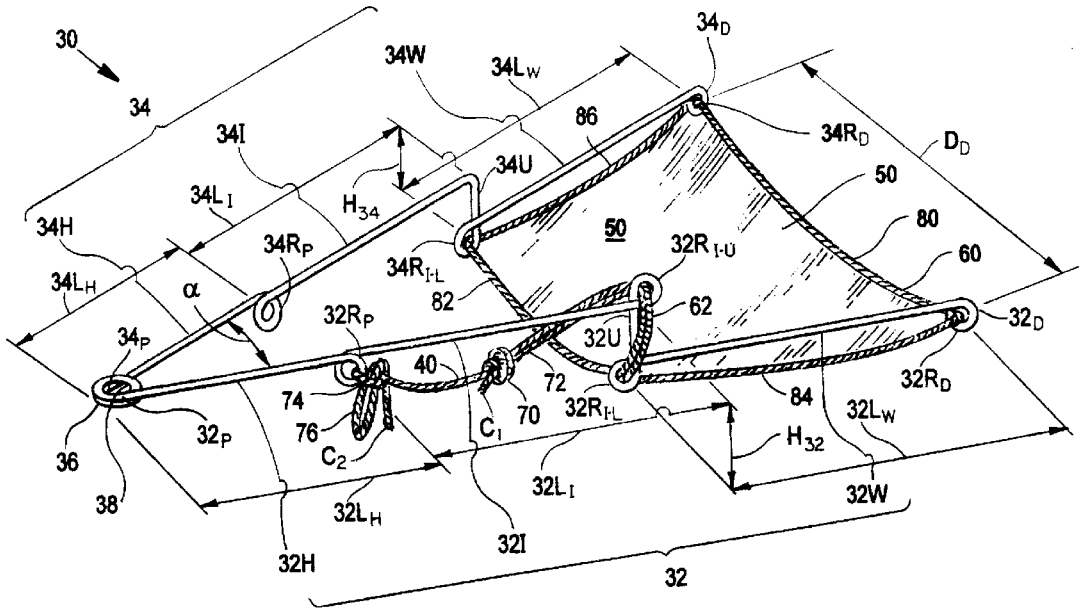
FIG. 1 is a perspective view of my bubble-making apparatus, with the limbs spread into an open, spread-apart, generally V-shaped orientation, and showing a generally trapezoidal shaped bubble-forming film retained within loop forming portions of a wettable, flexible cord.

Attention is directed to FIG. 1, where a perspective view of a typical embodiment of my invention is shown. A generally V-shaped bubble-making apparatus or "wand." 30 is provided. Bubble-making apparatus 30 has a first limb 32 having a proximal end $\mathbf{32}_P$ and a second limb 34 having a proximal end $\mathbf{34}_P$ that are operatively connected at junction 36. At the junction 36, a normally open and preferably integral spring mechanism 38 urges an increased angle alpha ($\alpha$) between the first limb 32 and the second limb 34. Thus, spring mechanism 38 urges an increased distance $D_D$ between the distal end $\mathbf{32}_D$ of first limb 32 and the distal end $\mathbf{34}_D$ of second limb 34. Ideally, the normally-open spring mechanism 38 applies only so much force that it can be easily overcome by the handgrip of a user U, as further described herein below.

A cord 40, preferably with flexible, supple, and absorbent qualities, is adjustably affixed to first 32 and second 34 limbs in a pre-selected shape. Preferably, the pre-selected shape is provided to achieve a somewhat trapezoidal shaped bubble-forming loop within which a bubble-forming film 50 adheres. In order to allow the pre-selected shape of cord 40 to be effectively deployed in my bubble-making wand 30, structural configurations for first limb 32 and of second limb 34 must be examined.

As shown in FIGS. 1, 2, 3, and 4, first limb 32 is preferably provided in a stiff, longitudinally extending, rod or wire-like material, with two or more spaced apart attachment locations, which for purposes of explanation with respect to the just mentioned figures will be called rings. This is convenient since either a loop shaped structural element formed out of a single rod or wire-like material (as illustrated in FIGS. 1–4) or a sidewall E defining a ring-like shape (as seen in some of the later embodiments, e.g., in FIG. 5) defines structural shape of many (but not all) of desirable attachment locations for cord 40. More broadly, it is to be understood that the use of the term "ring" is to merely define a place of attachment (i.e., an "attachment location") for a bubble-forming cord. Consequently, alternate structures for attachment locations, including those set forth in FIGS. 26–32, may be utilized when and as convenient, without materially departing from the intended scope and coverage of the claims set forth below.

Figure 3:
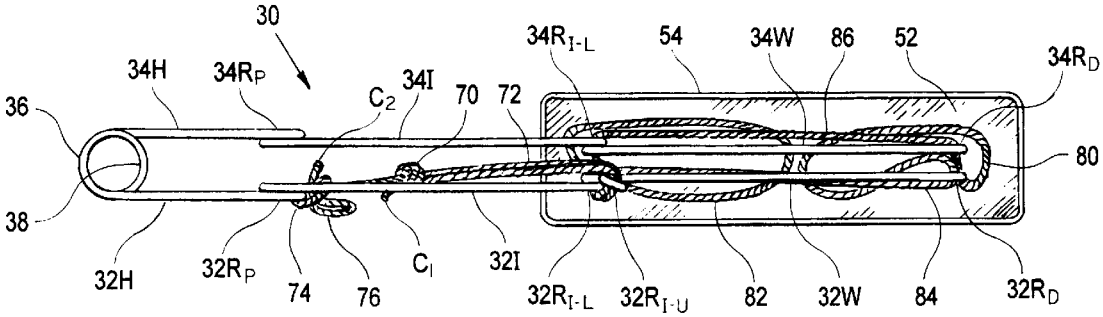
FIG. 3 is a top, plan view of the bubble-making apparatus first shown in FIG. 1 above, now illustrating the first step in a method for forming a bubble, with the limbs urged toward each other and pressed substantially together, and with the collapsed flexible loop forming wettable cord dipped into a bubble solution in a relatively small narrow width bubble solution container.
Figure 4:
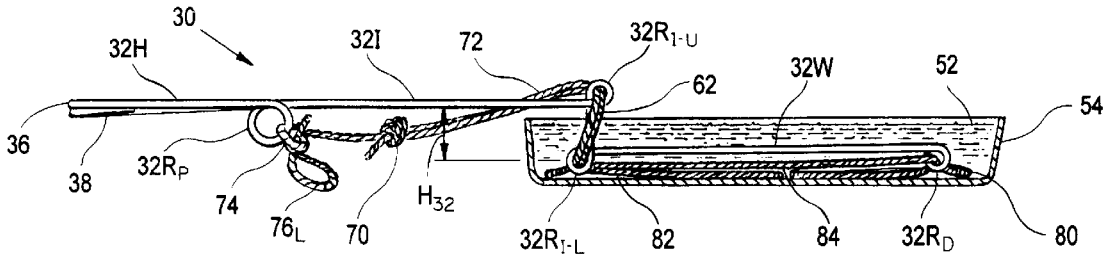
FIG. 4 is a side elevation view, with partial cross-sectional view through a bubble solution container, of the apparatus shown in FIG. 1 and FIG. 3 above, now illustrating a collapsed loop being dipped into a bubble solution.

Returning now to FIGS. 1–4, it is generally desirable that attachment locations include distal ring $\mathbf{32}R_D$, and a lower intermediate ring $\mathbf{32}R_{I\text{-}L}$. The distance between distal ring $\mathbf{32}R_D$ and lower intermediate ring $\mathbf{32}R_{I\text{-}L}$ is shown as the length $\mathbf{32}L_W$ of the working portion 32W of first limb 32. Since cord 40 must be wetted by dipping the cord 40 into a bubble-making solution 52 provided in a container 54 (as indicated in FIGS. 3 and 4, for example) it is convenient to provide an offset leg 32U of height $H_{32}$ is provided between the lower intermediate ring $\mathbf{32}R_{I\text{-}L}$ and the intermediate portion 32I of first limb 32. At the upper reaches of offset leg 32U, an upper intermediate ring $\mathbf{32}R_{I\text{-}U}$ is provided. The distance between upper intermediate ring $\mathbf{32}R_{I\text{-}U}$ and proximal ring $\mathbf{32}R_P$ is shown as the length $\mathbf{32}L_I$ of the intermediate portion 32I of first limb 32. The distance between the proximate ring $\mathbf{32}R_P$ and proximal end $\mathbf{32}_P$ of first limb 32 is shown as the length $\mathbf{32}L_H$ of the handle portion 32H of first limb 32.

Similar to first limb 32, the second limb 34 is preferably provided in a stiff, longitudinally extending, rod or wire-like material, and having two or more spaced apart rings including distal ring 34$R_D$, and a lower intermediate ring 34$R_{I-L}$. The distance between distal ring 34$R_D$ and lower intermediate ring 34$R_{I-L}$ is shown as the length 34$L_W$ of the working portion 34W of second limb 34. As seen in FIG. 1, an offset leg 34U of height $H_{34}$ is provided between the lower intermediate ring 34$R_{I-L}$ and the intermediate portion 34I of second limb 34. At the upper reaches of offset leg 34U, second limb 34 is turned toward proximal ring 32$R_P$. The distance between lower intermediate ring 34$R_{I-L}$ and proximal ring 34$R_P$ is shown as the length 34$L_I$ of the intermediate portion 34I of second limb 34. The distance between the proximate ring 32$R_P$ and proximal end 34$_P$ of second limb 34 is shown as the length 34$L_H$ of the handle portion 34H of second limb 34.

For installation of cord 40 in an operative position, a first end $C_1$ of cord 40 may be initially passed downward through lower intermediate ring 32$R_{I-L}$ in the first limb 32. Then, first end $C_1$ of cord 40 is passed through the distally situated ring 32$R_D$ in the same first limb 32. Next, the first end $C_1$ is passed through distal ring 34$R_D$, and then through lower intermediate ring 34$R_{I-L}$ of the second limb 34. Then, first end $C_1$ is passed back, upward through the its original location at the lower intermediate ring 32$R_{I-L}$ in the first limb 32, thus completing a bubble-forming loop 60 with cord 40.

To secure the cord 40, the first end $C_1$ is passed back through the upper intermediate ring 32$R_{I-U}$ of the first limb 32. Then, second end $C_2$ is passed back through the same upper intermediate ring 32$R_{I-U}$ of the first limb 32. A knot 70 is made in the free end 72 of the doubled-cord 62, thus fixing the maximum size of a large, trapezoidal shaped loop 60$_L$. Knot 70 also prevents the separation of the absorbent-supple-cord 40 from the wand 30. First end $C_1$ is stopped (i.e., is cut off) at or adjacent the knot 70. Finally, second end $C_2$ is passed through the proximal ring 32$R_P$ of the first limb 32. Generally, I have found it advantageous to temporarily fix second end $C_2$ in place with a slip-knot 74 for the duration of the use of any given loop size 60.

Figure 2:
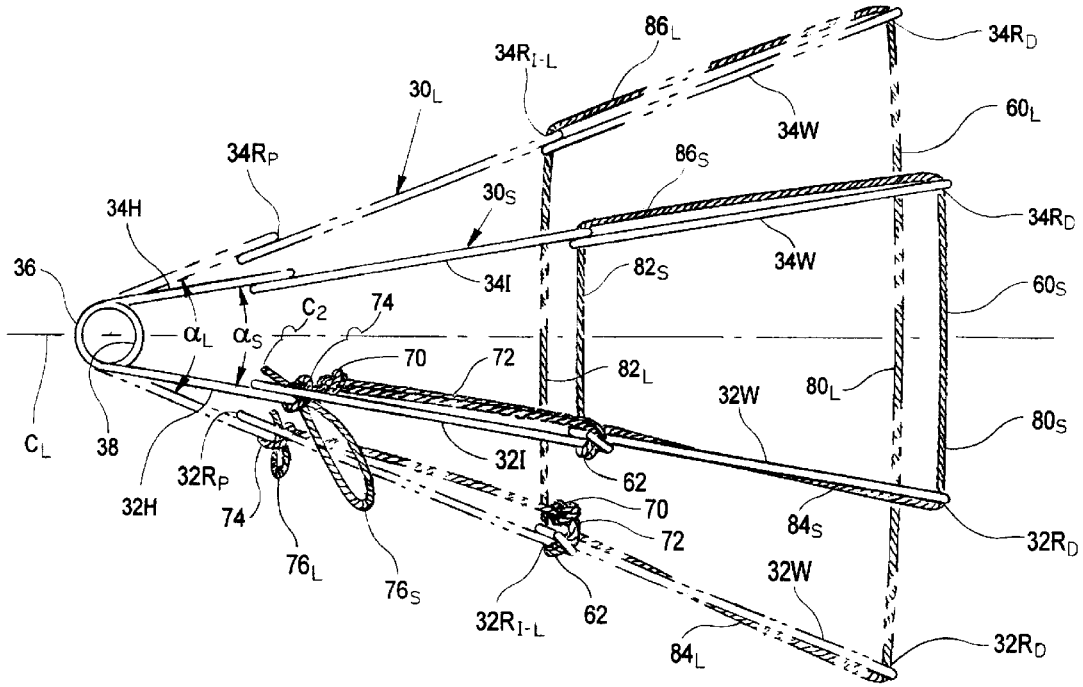
FIG. 2 is a top, plan view of the bubble-making apparatus first shown in FIG. 1, now shown with the limbs spread-apart in a generally V-shaped orientation, showing alternate, optional loop sizes formed by a wettable, flexible cord; loop sizes shown are of (a) moderate width, and (b) wide width, either of which can be achieved by adjusting the loop size to the limits fixed by a knot in the cord.

As can be appreciated by reference to FIG. 2, simply pulling doubled-cord 62 in a desired direction readily changes the size of the bubble-forming loop 60, from, for example, large loop 60$_L$ shown in hidden lines, to small loop 60$_S$ shown in full lines. The size of the loop is temporarily fixed by use of the slipknot 74, whether that size is large loop 60$_L$ or small loop 60$_S$, as further seen by reference to FIG. 2.

Since the sizes of lower intermediate ring 32$R_{I-L}$ and of lower intermediate ring 34$R_{I-L}$ are generally (but not necessarily) the same as the corresponding distal rings 32$R_D$ and 34$R_D$, respectively, the doubled-cord 62 will not readily slip in lower intermediate ring 32$R_{I-L}$, but the single absorbent, supple cord 40 which forms loop 60 will easily slip through rings 32$R_D$, 34$R_D$, and 34$R_{I-L}$. The doubled-cord 62 is passed through upper intermediate ring 32$R_{I-U}$, which, advantageously may be provided in substantially the same size as lower intermediate ring 32$R_{I-L}$, temporarily fixes the doubled-cord 62, and thus maintains the size of the loop 60 against the tension of the spring mechanism 38 at junction 36.

I have found it advantageous to include in a wand 30 structure the downwardly oriented (when wand 30 is held horizontal) proximal rings 32$R_P$ and 34$R_P$ as the squeeze points for a user U to manipulate to urge the two limbs 32 and 34 toward each other. However, a user U can accomplish pressing the first 32 and second 34 limbs toward each other with a single hand, without such proximal rings 34$R_P$ and 32$R_P$, to decrease the angle alpha ($\alpha$) between first limb 32 and second limb 34.

The size of the loop 60 can be readily varied from a small loop 60$_S$ to a large loop 60$_L$ as illustrated in FIG. 2. This is accomplished by simply undoing the slip-knot 74 (see FIG. 1), and pulling the doubled-cord 62 in the proper direction. FIG. 2 illustrates the change of position of the knot 70, as the loop 60 is changed from a small loop 60$_S$ to a large loop 60$_L$. Also, a when a small loop 60$_S$ is provided, a large bight 76$_S$ results, and when a large loop 60$_L$ is provided, a small bight 76$_L$ results. These have been labeled with the subscript indicating the size of the bubble-forming loop 60, rather than the size of the bight 76. It is important to note that the bubble-forming loop 60 can be easily changed to, and maintained at, any size between the small loop 60$_S$ and a large loop 60$_L$. Note that changing the size of loop 60 also changes the angle alpha ($\alpha$) between first limb 32 and second limb 34 when the wand 30 is in its normal fully opened position. As shown in FIG. 2, a large angle alpha ($\alpha_L$) is shown when wand 30$_L$ is provided with a large loop 60$_L$. A smaller angle alpha ($\alpha_S$) is provided when a small loop 60$_S$ is set up for use with a smaller loop configured wand 30$_S$. So, in FIG. 2, there are two different configurations illustrated, namely a wide angular width shown for use of a large loop 60$_L$ and alternately, a narrow angular width shown for use of a small loop 60s. For clarity, it should be understood that FIG. 2 does not illustrate two positions of wand 30 while using a single loop 60 size.

Operation

Use of wand 30 at a single pre-selected loop 60 size is now shown and explained in conjunction with FIGS. 2, 3, and FIGS. 37 through 42. First, as shown in FIG. 3, by simply squeezing the two limbs 32 and 34 together, the elements of cord 40 that form loop 60 collapse. More specifically, as easily seen in FIGS. 1 and 2, the cord 40 which forms loop 60 has a distal edge portion 80, a proximal edge portion 82, a first side portion 84, and a second side portion 86, all of which cooperate to form loop 60. A collapsed loop 60 can be dipped into the bubble solution 52 in the long, narrow container 54, as illustrated in FIGS. 3 and 4, or as an alternate embodiment, in FIG. 25.

To form bubbles with my wand 30, the user U clasps the wand 30 near the junction 36 of the limbs 32 and 34, along handle portions 32H and 34H. By squeezing the first and second limbs 32 and 34 together, the loop .60 is collapsed, and in the collapsed form, the portions of cord 40 which provide the elements forming loop 60 are dipped into the bubble solution 52. Gently raising the wand 30 with the limbs 32 and 34 squeezed together as illustrated in FIG. 37, raises the collapsed loop 60 from the bubble solution 52. As the loop 60 is not yet fully formed to its bubble-making size, the bubble solution film 50, which tends to minimize its total surface area, is easily able to remain intact as the collapsed loop 60 is withdrawn from the bubble-making solution 52. Turning now to FIG. 38, by continuing the upward motion by swinging an arm 90 in the direction of reference arrow 92, and gently easing the pressure between first and second limbs 32 and 34, the user U causes the first and second limbs to spread, thereby increasing the angle alpha ($\alpha$) therebetween. In this manner the loop 60 is allowed to gently open, allowing the bubble-making film 50 to fully form. Continuation of upward motion of arm 90 as indicated by the reference arrow 94 in FIG. 39 will cause the solution film 50 to become tubular in form, now indicated by reference numeral 50$_T$. Adding (to the upward motion) a circular motion as indicated by reference arrow 96 in FIG. 40 will fully extend the bubble tube $\mathbf{50}_T$. Then, by gently squeezing the first 32 and second 34 limbs together to begin to collapse loop 60, the bubble tube $\mathbf{50}_T$ will begin to 'close off'. As indicated in FIG. 41, continuing the circular motion as indicated by reference numeral 98, with the first and second limbs 32 and 34 fully brought together, completes 'closing off' of the bubble tube $\mathbf{50}_T$ to form and thus release bubble 100. The just described motion results in a desirable trajectory for bubble 100, specifically a slowly spinning bubble 100 which has a slow upward trajectory when formed. Continuing the circular motion as shown in FIG. 42, the user U basically returns to, the initial bubble-forming position earlier indicated in FIGS. 37 and 38, wherein the limbs 32 and 34 can again be spread apart to form a second bubble $\mathbf{100}_2$.

The bubble-forming process can then be repeated, and the remake of additional bubbles $\mathbf{100}_1$ through $\mathbf{100}_N$ (where N is a positive integer) can be continued until the quantity of the bubble solution 52 within or on cord 40 is insufficient to completely form a bubble-making film 50 on a particular size of loop 60. The size of the loop 60, the bubble solution 52 mix, the weather conditions, and the skill and technique of the user U will dictate the size, number, and even the persistence of bubbles $\mathbf{100}_1$ through $\mathbf{100}_N$. Often, many bubbles 100 can be formed by a user U before the loop 60 will require redipping into the bubble solution 52. For example, based on initial prototype testing, I anticipate that production units will be able to make twenty (20) or more bubbles 100 of approximately sixteen (16) inch diameter in size before re-dipping of the cord 40 into the bubble-making solution 52 will be required.

Variations in Construction

Various bubble making wands similar in operation to the wand 30 just described above can be fabricated of suitable materials.

A few other embodiments for a desirable wand, employing other structural configurations, are illustrated in FIGS. 5, 6, and 7.

For ease of fabrication via injection molding, limbs of the general structure illustrated in FIGS. 1 through 4 may be imitated, however, a wand 130 as shown in FIG. 5 may be more practical in such situations. In FIG. 5, a first or right-hand limb 132 is illustrated. Of course, it is to be understood that a second or left-limb 134, although not illustrated, is of similar construction and form, except with respect to the asymmetric absence of an upper intermediate ring in the second limb 134, similar to the configuration illustrated with respect to wand 30 in FIGS. 1 through 4. In wand 130, the various spaced apart rings, including distal ring $\mathbf{132}R_D$, lower intermediate ring $\mathbf{132}R_{I\text{-}L}$, upper intermediate ring $\mathbf{132}R_{I\text{-}U}$, and proximal ring $\mathbf{132}R_P$, are each preferably in the form of circular apertures defined by a side wall portion E. However, the alternative structures for attachment locations as discussed above and as illustrated in FIGS. 26 through 32 may be utilized as desired. From the junction 136 outward, a handle portion 132H is provided in a handle gripping width W along an outwardly extending handle gripping distance $\mathbf{132}L_H$. An intermediate offset leg 132U of height $H_{132I}$ is provided between the low intermediate ring $\mathbf{132}R_{I\text{-}L}$ and the intermediate portion 132I of first limb 132. A extending upward from intermediate offset leg 132U provides structural material for locating an upper intermediate ring $\mathbf{132}R_{I\text{-}U}$ and the necessary downward offset $H_{132}$ of the lower intermediate ring $\mathbf{132}R_{I\text{-}L}$ to dip the bubble-forming loop 60 into the bubble solution 52 within the bubble solution container 54. At the distal end 132D of first limb 132, a downwardly extending dip leg 132G is provided. The dip leg 132G is offset downward from working portion 132W of first limb 132 by a height of height $H_{132G}$. Ideally, all of the wand 132 parts, as shown and identified in FIG. 5, are provided in an integral, one-piece construction.

However, the form of the limbs to downwardly offset the bubble-forming loop 60 to permit the dipping of the flexible absorbent-cord 40 into the bubble solution may be of other structural configurations so long as the functionality is preserved, and the various sidewall portions E which define rings $\mathbf{132}R_D$, $\mathbf{134}R_D$ (not shown), $\mathbf{134}R_{I\text{-}L}$ (not shown), and $\mathbf{132}R_{I\text{-}L}$ may alternately be provided in other structural configurations, such as those structures seen in FIGS. 26 through 32.

More generally, where other configurations are provided for bubble forming wands, the bubble-forming loop 60 can be fixed by structures or means other than the downward oriented first and second distal rings $\mathbf{132}R_D$, $\mathbf{134}R_D$ (not shown) illustrated in this FIG. 5, or the downward oriented first and second lower intermediate rings $\mathbf{132}R_{I\text{-}L}$, $\mathbf{134}R_{I\text{-}L}$ (not shown) illustrated in this FIG. 5. For any alternate wand configuration X (in a series alternate configurations 1 through X, where X is an integer of 1 or greater, as X=0 for the base configuration of wand X30) may be provided for a first limb X32 and for a second limb X34, and for any intermediate limb or limbs X33. In such cases, the attachment of absorbent-cord 40 to a wand X30 may utilized the various embodiments for an attachment location as illustrated in FIGS. 26 through 32, and as further described or suggested below as other embodiments of, this invention are described.

Larger Wands for Larger Bubbles

Almost everyone who has made bubbles has wished at one time or another to be able to make very large bubbles. Very large bubbles require very large loops $\mathbf{60}_L$. Turning now to FIGS. 6 through 10, various structures which enable a user U to form very large bubbles are illustrated. First, in FIG. 6, a first or right-limb 232 for a wand 230 with the capacity to form a very large loop $\mathbf{60}_L$ is illustrated. Such a large wand 230 might be more practical if fabricated of piece parts, as illustrated in this FIG. 6, but could, of course, be provided in an integrally constructed fashion. A large wand 230 for the formation of large bubbles may be constructed with a separate shaft 232S subassembly can be of greater structural integrity and/or less weight than wire forms of the type provided in wand 30 discussed above. Also, a wand of the type illustrated as wand 230 in this FIG. 6 may prove less costly to manufacture than a single injection molded part of the same length, such as one of the type as illustrated in FIG. 5 with respect to wand 130. It is to be understood that a left-limb 234, although not illustrated, is of similar construction and form, except with respect to the asymmetric absence of an upper intermediate ring in the second limb 234, so that the overall configuration is similar to the configuration illustrated with respect to wand 30 discussed extensively above.

A first straight shaft portion 232S forms both intermediate portion 232I and the working portion 232W. The shaft portion 232S and similar second shaft portion 234S (not shown) are attached to a junction-piece 236. The junction-piece 236 forms the base structure of the wand 230. Junction-piece 236 is provided in a V-form, with a normally open spring action, functionally operating as described hereinabove. Alternate structures for the junction-piece 236 will be further described hereinbelow. A dip leg 232G, incorporates distal ring 232$R_D$. An intermediate offset leg 232U is provided, incorporating a downwardly extending ear 232E and an upwardly extending knob 232K, a lower intermediate ring 232$R_{I\text{-}L}$, and upper intermediate ring 232$R_{I\text{-}U}$, respectively. Proximal ring 232$R_P$ is provided in junction-piece 236 for temporary securement of cord 40 and slip-knot 74. This intermediate offset leg 232U of first limb 232, and intermediate offset leg 234U of second limb 234 may be permanently attached to its respective limb, or slidably temporarily fixed to allow the user to further adjust the size of the bubble making loop 60 over and above that allowed by the change of angle alpha ($\alpha_L$) to angle alpha ($\alpha_G$). Overall, each of various rings generally are configured to serve the same purpose and functionality as their corresponding ring location as more fully explained above with respect to wand 30.

Turning now to FIGS. 7, 8, 9, and 10, a wand 330 with telescoping type limbs is illustrated. A first-limb 332 can be seen in FIG. 7. First limb 332 has a telescopic structure including at least one extending telescopic element (providing at least a two-piece telescopic structure). Preferably, a working portion 332W is provided which telescopes into and nests in a hollow intermediate portion 332I. The exact longitudinal position of the slidably nested portion of working portion 332W within the hollow intermediate portion 332I can be fixed by any convenient device or means, such as by use of a structure which provides friction pressure exerted against the outer surface 348 of working portion 332W by tightening a knurled knob 349 of compression-collar clamp 350. Such a mechanism can utilize a simple threaded compression-collar-clamp 350 (such as used with the lock rings employed on the tubular legs of camera tripods) effectively constrains at any desired length 332$L_{W\text{-}E}$ of the slidably nested forward or working portion 332W of first limb 332. However, any convenient securing device (not only the compression collar illustrated) can be employed to fix the forward, working portion 332W to the intermediate portion 332I. Other examples include, but are not limited to, a device such as a simple series of holes and a locking pin.

As noted above, the actual extended working length of the working portion 332W of first limb 332 is temporarily fixed at a pre-selected length 332$L_{W\text{-}E}$, as can be seen in FIG. 7. By use of the telescoping feature, the working portion 332W of first limb 332 can be shortened to length 332$L_{W\text{-}S}$, as shown in FIG. 8. For storage, any intermediate length required to allow further freedom by the user to vary the size of the bubble-forming loop 60 and/or the use of various size bubble solution containers. Wands of the type taught by this wand 330 are generally more practical as a device to make gigantic bubbles, such as bubbles in a size of over 6 feet in diameter. However, wand 330 and those of similar design are not limited to use with large bubbles, and even moderate size bubbles may be practical with a shorter working portion.

As better seen in the perspective view provided in FIG. 10, a junction piece 336 is utilized to join the first limb 332 with second limb 334. More specifically, the intermediate portion 332I of first limb 332, and the intermediate portion 334I of second limb 334, are joined to junction piece 336 at receiving sockets 332S and 334S, respectively. Junction-piece 336 is preferably in a V-form, so as to form a resting angle alpha ($\alpha$) between first 332 and second 334 limbs, with a normally open type springing mechanism integral thereto, so as to functionally operate to spread first 332 and second 334 limbs as the other embodiments already described.

At the distal end 332D of working portion 332W of first limb 332, a downwardly extending leg 332G is provided, incorporating a distal ring 332$R_D$. As a structural alternative, a cap portion 332C on leg 332G can be used to affix leg 332G at the distal end 332D of working portion 332W of first limb 332. Similarly, cap 334C is used to affix leg 334G at the distal end 334D of working portion 334W of second limb 334.

An intermediate offset portion 332U is provided at or near the distal extremity of intermediate portion 332I of first limb 332. The intermediate offset portion 332U includes a downwardly extending ear portion 332E, incorporating material in which lower intermediate ring 332$R_{I\text{-}L}$ is defined by an aperture edge sidewall portion E. The intermediate offset portion 332U also includes an upwardly extending knob portion 332K, incorporating material in which upper intermediate ring 332$R_{I\text{-}U}$ is defined by an aperture edge sidewall portion E. The offset portion 332U preferably includes a substantially annular shaped attachment portion 332A that is sized and shaped for close fitting attachment to and securing with the surface 360 of intermediate portion 332I of first limb 332. Similarly, the annular shaped attachment portion 334A on second limb 334 is closely fitting over surface 362 of intermediate portion 334I. Such structures 332A and 334A are better appreciated by reference to FIG. 9, where the close fitting nature of attachment portion 332A over the surface 360 of intermediate portion 332I is clearly evident. Moreover, it is to be understood that certain elements with respect to the second limb 334 have not been specifically called out, but are illustrated on in the various figures of the drawing with a "334" prefix rather than the "3321" prefix used with respect to parts associated with the first limb 332, and those of skill in the art and to which this specification is directed may easily understand the structure and function of parts with a "334" prefix by reference to their counterparts having a "332" prefix.

As illustrated in FIG. 10, the absorbent-supple cord 40 is provided to form a bubble-forming loop 60. The various loop parts, knots, etc., are substantially the same as described above with respect to wand 30, and consequently, identical reference numerals are utilized, and further explanation is unnecessary.

Turning now to FIG. 14, a parallelepiped shaped loop 60, such as a square or a rectangle, is feasible in providing a desirable bubble-making wand, as shown by the wand 430 now illustrated. A first limb 432 and a second limb 434 are joined at junction 436. As similar to like structures earlier described, junction 436 provides a normally open, stable position of a preselected angle of rest alpha ($\alpha_R$). However, junction 436 provides an angularly increasing spring force which urges first limb 432 and second limb 434 apart when limbs are first compressed toward one another, so that limbs 432 and 434 return to the rest angle alpha ($\alpha_R$). Importantly, the spring force is preferably of moderate resistance so that any pre-selected user U is able to easily manually squeeze first limb 432 and second limb 434 toward each other while gripping wand 430 with one hand. This spring force action, and resting angle alpha ($\alpha_R$) is an important attribute in various embodiments of my invention.

A first pivotal working member 432P is pivotally attached at pivot attachment 440 to the distal end 432D of the first limb 432. A second pivotal working member 434P is pivotally mounted at pivot attachment 442 to the distal end 434D of the second limb 434. First pivotal member 432P includes a first arm 470 and a second arm 472 extending from a pivot pin 474. A downwardly extending first end leg 476 is located at or near the radial end of first arm 470. A downwardly extending second end leg 478 is located at or near the radial end of second arm 472. A downwardly extending central leg 480 is centrally located along pivotal member 432P, preferably below pivot pin 474. An attachment location at distal ring 432$R_D$ is located in the lower reaches of first end leg 476. An attachment location at intermediate ring 432$R_{I-L}$ is located in the lower reaches of second end leg 478. An attachment location at a lower central ring 432$R_{C-L}$ is located in the lower reaches of central leg 480. An attachment location at the upper central ring 432$R_{C-U}$ is located in knob 432K, attached at distal end 432D of first limb 432.

A second pivotal member 434P includes a first arm 480 and a second arm 482 extending from a pivot pin 484. A downwardly extending first end leg 486 is located at the radial end of first arm 480. A downwardly extending second end leg 488 is located at the radial end of second arm 482. An attachment location at a distal ring 434$R_D$ is located in the lower reaches of first end leg 486. An attachment location at an intermediate ring 434$R_{I-L}$ is located in the lower reaches of second end leg 488.

A flexible, absorbent, supple cord 40 forming the parallelepiped loop 60 is brought together at the attachment location designated as lower central ring 432$R_{C-L}$. Preferably, in this embodiment, at the various cord attachment locations, the preselected size (i.e., diameter) of various rings (432$R_D$, 434$R_D$, 434$R_{I-L}$, 432$R_{I-L}$, and 432$R_{C-L}$) that define the form of loop 60 are only very slightly larger in diameter than the diameter of the selected cord 40, so that the sidewalls E of the rings have a relatively tight fit about the cord 40, so that cord 40 does not appreciably slip. Consequently, during use, the first pivotal member 432P preferably remains substantially parallel to the second pivotal member 434P, and therefore the locational and angular relationship of the various attachment locations, i.e., the rings just set forth above, form the shape (including the corners), of a selected parallelepiped. The loop 60 can be adjusted into a square form, or into a rectangular form, or other shapes of varying sizes. Alternately, the first 432P and second 434P pivotal members can be re-oriented and spread into a generally V-shaped form, to provide a generally trapezoidal shape. Loop 60 starts, and ends, at the lower central ring 432$R_{C-L}$, which then provides a double cord 62 in reasonable proximity to upper central ring 432$R_{C-U}$. Although the first edge 84 of loop 60 has two portions, 841, and 842, overall the elements making up the loop 60 and the various knots, bight, and cord ends, are substantially the same if not identical to those as described with other embodiments, and thus in this FIG. 14 bear identical reference numerals. The cord 40 is tied off at a proximal ring, 432$R_P$, which is located at or near the proximal end of first limb 432 (not including the handle portion 432H of first limb 432).

Turning now to FIG. 15, a bubble-making device 530 incorporating at least one intermediate-limb 533 is illustrated. Such devices need not be limited to only one intermediate-limb 533, but can incorporate any desired number from 1 to Z (where Z is a positive integer) of intermediate limbs 533. As illustrated, a first limb 532 and a second limb 534 are provided, in similar fashion to other embodiments illustrated above. However, junction 536 accommodates the intermediate-limb 533. Each of limbs 532, 533, and 534 has, at their respective distal ends 532D, 533D, and 534D, downwardly extending legs 532G, 533G, and 534G, respectively. These legs provide material in which the distal rings 532$R_D$, 533$R_D$, and 534$R_D$, respectively, are defined by side walls E. At a selected working length for each limb, for example, 532$L_W$ in first limb 532, and 533$L_W$ in intermediate limb 533, and 534$L_W$ in second limb 534, a downwardly extending offset portion is provided, namely, offsets 532U, 533U, and 534U, respectively. Located in the lower reaches of these offsets are the lower intermediate rings 532$R_{I-L}$, 533$R_{I-L}$, and 534$R_{I-L}$, respectively. At first limb 532, the offset 532U includes an upwardly extending knob 532K, in which an attachment point shown as the upper intermediate ring 532$R_{I-U}$ is provided. The various attachment locations, here shown as rings 532$R_{I-L}$, 532$R_D$, 533$R_D$, 534$R_D$, 534$R_{I-L}$, 533$R_{I-L}$, and 532$R_{I-U}$ all cooperate to define the configuration of loop 60 when the wand 530 is in its normally open, spread apart configuration of angle alpha ($\alpha_R$), yet allow the elements forming loop 60 (namely, loop portions 84, 80$_1$, 80$_2$, 86, 82$_1$, and 82$_2$) to collapse when limbs 532, 533, and 534 are brought together. The intermediate-limb 533 does not interfere with the bubble-making capability of wand 530, as the bubble film 50 is formed along a bubble-making plane at the lower reaches of the wand 530.

Attention is now directed to FIGS. 11, 12, and 13, where various embodiments for a "junction" between a first limb and a second limb are illustrated. Such junctions may provide advantageous alternates to the various junctions identified with reference numerals 36, 136, 236, 436, etc., or any similar junctions as set forth herein. In FIG. 11, junction 36 of the first limb 32 and second limb 34 (or its analogues with a "prefix" in the "hundred" place as shown in the various figures herein) is not limited to the precise forms illustrated, but can take a structural configuration which functionally provides a normally-open springing nature to spread the first and second limbs into an opened V-shaped form after first and second limbs have been compressed toward each other during manual manipulation of a wand. Also, FIGS. 10 and 12 illustrate an embodiment incorporating an intermediate wedge 338, sandwiched between the handle portion 332H of first limb 322 and the handle portion 334H of the second limb 334. FIGS. 10 and 12 also illustrate the use of a pair of fasteners 339, but any suitable fastening device may be employed to secure the first limb 332 and the second limb 334 together in a normally-open, springing apart yet manually closeable relationship. The intermediate wedge 338 may take a variety of forms and shapes. Also, the intermediate wedge 338 can be of a rigid nature if deformable, springing type limbs 332 and 334 are utilized. Or, the intermediate wedge 338 can be of an elastic nature, with rigid limbs 332 and 334. Alternately, a combination of such advantageous features can be utilized in any desired manner, just so long as the loop 60 can be allowed to open, and then be manually collapsed for wetting loop 60 in a container 54 of bubble-making solution 52.

FIG. 13 illustrates another alternate embodiment 36' for junction 36. In this embodiment, a hinge 590 is utilized to join first limb 32 and second limb 34, and an elastic wedge 592, preferably generally trapezoidal shaped, is attached, preferably in a flush fitting fashion, between first limb 32 and second limb 34. Alternately, a normally open mechanical spring structure can be used to perform the equivalent function in place of the elastic wedge 592.

Turning now to FIGS. 16 and 17, great number of bubbles can be formed at the same time if one uses a great number of hoops. FIG. 16 illustrates a framework 602 supporting a multitude of small-hoops 604. The small-hoops 604 are separated into a plurality of narrow-width groups 606. The importance of the narrow width groups 606 is illustrated in FIG. 17. Here, a framework 602 attached to a typical wand 630. A narrow-width group 606 of hoops 604 has a width $\mathbf{606}_W$ (see FIG. 16) and a length $\mathbf{606}_L$ and can individually fit within the preselected bubble solution container 54 of length $L_{54}$ and of narrow width $W_{54}$. So, the total compliment of the small-hoops 604 can be saturated with a bubble-making solution 52 by dipping each narrow-group 606 individually into the bubble-making solution 52.

The front support leg 608 has a width $\mathbf{608}_W$ which coincides with the greatest separation D, of the distal ends 632D and 634D of first and second limbs 632 and 634, respectively of the wand 630. A first front clip 610, and a second front clip 612 at the lateral extremities of front support leg 608 fit may be provided to fit into separate attachment locations, which would then become clip accepting apertures 614 and 616 in first downward leg 632G and second downward leg 634G, respectively. Alternately, and as actually illustrated, clips 610 and 612 can be adapted to fit into attachment locations formed by distal rings $\mathbf{632}R_D$ and $\mathbf{634}R_D$, respectively.

A first rear clip 620, and a second rear clip 622 are slidably retained on a rear support leg 628. The first rear clip 620 mates at an attachment location with lower intermediate ring $\mathbf{632}R_{I\text{-}L}$ of the first limb 632. The second rear clip 622 mates at an attachment location with lower intermediate ring $\mathbf{634}R_{I\text{-}L}$ of the second limb 634. When in this configuration, the primary loop 60 of cord 40 is not actively used for the bubble-forming process, but when tightened, will retain the front clips 620 and 622 within the lower intermediate ring $\mathbf{632}R_{I\text{-}L}$ of the first limb 632 and the lower intermediate ring $\mathbf{634}R_{I\text{-}L}$ of the second limb 634.

Small hoops 604 do not require intricate twisting movement with respect to operation of wand 30 in order to keep the bubble-forming film 50 of bubble solution intact when withdrawing it from the bubble solution 52. Moreover, small bubbles formed from small hoops do not require 'closing off'. Thus, each small-hoop 604 will perform identically, as a tiny hoop, when provided with a commercial bubble solution. The small-hoops 604 may be circular but need not be circular, nor identical, but can assume any closed form where the bubble-making solution can completely wet across the hoop 604 form. The preferred surface of these small hoops 604 is a textured surface 640 (see FIG. 17), to assist in the retention of the bubble-making solution on the hoop structure 604. However, the surface with respect to small bubble making hoops is usually not critical, and most any surface quality can be utilized. Importantly, this accessory item bubble making framework 602 will enable the user U to make a 'cloud' of bubbles, i.e., provide a great multitude of small bubbles at one time.

As further seen in FIG. 18, simplified wand structures such as the wand 730 illustrated are feasible, and it is to be understood that the size of a bubble-making loop need not be adjustable. Here, a fixed length loop 760 (including portions 80, 82, 84, and 86) is provided. It is important to understand that my unique wands as taught herein can function advantageously even when a loop 760 of fixed size is provided. For example, in this FIG. 18, wand 730 utilizes an absorbent, supple cord to form a loop 760 of a fixed size. Here, wand 730 has a first limb 732 and a second limb 734 joined at junction 736 utilizing the above described normally open integral spring action between limbs 732 and 734, and wherein an uncompressed angle alpha ($\alpha_R$) separates the limbs 732 and 734. Handle portions 732H and 734H are provided for easy gripping of the wand 730 in a single hand of a user U. At distal ends 732D and 734D of limbs 732 and 734, downwardly extending legs 732G and 734G are provided, respectively. At a preselected working distance 732L, toward the proximal end of limb 732, a downwardly extending intermediate offset leg 732U is provided. Similarly, at a preselected working distance $\mathbf{734}L_W$ along toward the proximal end of limb 734, a downwardly extending intermediate offset leg 734U is provided.

Loop 760 of fixed size is affixed through the attachment locations at (1) the distal ring $\mathbf{732}R_D$ in leg 732G, (2) through distal ring $\mathbf{734}R_D$ in leg 734G, (3) through lower intermediate ring $\mathbf{734}R_{I\text{-}L}$ in leg 734U, (4) and through lower intermediate ring $\mathbf{732}R_{I\text{-}L}$ in leg 732U. As illustrated in FIG. 18, no "proximal rings" are provided, since it is not necessary to "tie-off" the cord making up the fixed loop 760. Of course, such a proximal ring could also be provided to tie of a selected length of cord, to provide the structural and functional equivalent of an integral fixed length loop 760 as shown. As illustrated, the loop 760 will define a fixed size when the wand 730 is in its open position. When the first 732 and second 734 limbs are brought together, the loop 760 will collapse, just as in other embodiments illustrated. A bubble-making device of this nature will only be capable of making bubbles of, or up to, a particular size, but will function just as well, within such limits, as other illustrated embodiments of this invention.

Attachment of Cord

Attention is now directed to FIGS. 19 through 36, where various structures and methods for attachment of a flexible cord are illustrated. In the FIGS. 19 through 36, only partial drawings are provided of such alternative embodiments, as it will be clear to one of ordinary skill in the art and to which this invention is addressed, as well as to the court and/or fact finder who may be charged with interpreting the claims attached hereto and further defining the protectable scope of my invention, or of evaluating the infringement thereof, that wands similar to those herein described can be easily fabricated utilizing the "working end" or bubble-forming component structures as partially shown, and mirror images of such structures as appropriate, or suitable mix-match combinations of the depicted devices can be utilized, without materially departing from my invention, as claimed. In this regard, the various wands and their components in FIGS. 19 through 36 may be referred to as wand X30, where a positive integer in a series from 1 to X may be substituted in the reference numeral to provide a wand number X30. So, as just explained, wands 830, 930, 1030, 1130, 1230, 1330, 1430, 1530, 1630, 1730, 1830, and 1930 are set forth in FIGS. 19, 20, 21, 22, 23, 24, 25, 26, 33, 34, 35, and 36 respectively. Also, the various components in such figures are numbered X32 (for the first limb) and X34 (for the second limb) and so on with suffix numbering similar to those reference numerals otherwise already set forth herein. Thus, except where newly introduced structures require additional explanation, such numbering for already explained components need not be each individually discussed further.

Now turning to FIG. 19, a flexible absorbent-cord defining the bubble-forming loop 60 is attached to a wand 830 by use of attachment locations at angularly offset ears. Here, distal ear $\mathbf{832}E_D$ is offset outwardly at an angle epsilon ($\epsilon$) of ninety (90) degrees or so from the downwardly extending distal leg 832G. Cord 60 is affixed at an attachment place or attachment location labeled with reference numeral $\mathbf{832}AP_D$, which structure performs the same function as earlier described "rings" used for attachment locations. An equivalent function can also be provided by alternate structures for attachment locations as shown in FIGS. 26 through 32, or equivalents of such structures.

Similarly, the bubble forming loop 60 is attached to wand 830 by use of an angularly offset ear 832$E_{I-L}$, which is offset outwardly at an angle iota (I) of ninety degrees or so from the downwardly extending offset leg 832U.

More generally, it is to be understood that the exact form and orientation of the first and second distal attachment locations X32$AP_D$, and X34$AP_D$ respectively, (which, in FIG. 19 correspond to 832$AP_D$ and 834$AP_D$) and the first and second lower intermediate attachment locations X32$AP_{I-L}$, X34$AP_{I-L}$, (which in FIG. 19 correspond to attachment locations 832$AP_{I-L}$, 834$AP_{I-L}$) may be varied considerably, so long as the function of the attachment location of positioning the cord 60 is preserved in a manner which allows it to be wetted with bubble-making solution and then to perform its bubble-formation function.

Attention is now directed to FIGS. 19, 20, 21, 22, 23, 24, 25, 33, 34, 35, and 36, wherein various embodiments showing distal attachment location X32$AP_D$ and lower intermediate attachment location X34$AP_{I-L}$ are illustrated. In FIGS. 23 and 24, for example, the use of an aperture with a sidewall E is illustrated, but again, any of the attachment location substitutes indicated in FIGS. 26 through 32, or functional equivalents thereof, may be advantageously utilized.

Also, it is to be understood that the lower intermediate attachment location X32$AP_{I-L}$ and distal attachment location X32$AP_D$ (and corresponding locations on other legs such as leg X34) may but need not be orientated downward, it is only important that these attachment locations be situated such that the attached bubble-forming loop 60 is permitted to be immersed into the bubble solution 52 within a preselected solution container 54.

As already noted, FIG. 19 illustrates a first distal attachment location 832$AP_D$ and a first lower intermediate attachment location 832$AP_{I-L}$ that are oriented other than in a downward direction. As illustrated, the first distal attachment location 832$AP_D$ and the first lower intermediate attachment location 832$AP_{I-L}$ are provided, in a ring type design similar to the first distal ring 132$R_D$, and the first lower intermediate ring 132$R_{I-L}$ of the first limb 132 of the embodiment shown in FIG. 5 above. However, in this FIG. 19, the attachment locations are on ears 832$E_D$ and 832$E_{I-L}$, which are oriented in a different plane relative to their respective supporting downward offsets 832G and 832U, as well as to the remainder of the first limb 832.

The first distal attachment location 832$AP_D$ and the first lower intermediate attachment location 832$AP_{I-L}$, and corresponding (but not illustrated) second distal attachment location 834$AP_D$ and a second lower intermediate attachment location 834$AP_{I-L}$, of a second limb 834 (not illustrated), provides a location for the sidewalls E to position the bubble-forming loop 60 to provide functional control the bubble-forming loop 60, and insures that the loop 60 can be dipped into the available bubble-forming solution.

Also, it is to be understood that while FIG. 19 depicts both the first distal attachment location 832$AP_D$ and the first lower intermediate attachment location 832$AP_{I-L}$ as having the same, outward directed orientation, these first and second attachment locations, more generally X32$AP_D$ and X32$AP_{I-L}$, (or X34$AP_D$ and X34$AP_{I-L}$), can be oriented in any manner, with both towards the center line $C_L$ (see FIG. 2, for example) of the wand X30, or both away from the centerline of the wand X30, or with one ear (832$E_D$, for example) and towards, and the other ear (832$E_{I-L}$, for example) away from the center line of the wand X30.

Attention is now directed to FIG. 20, which depicts a first distal attachment location 932$AP_D$, and a first lower intermediate attachment location 932$AP_{I-L}$, that are provided in a opposing orientation with respect to each other. The first distal attachment location 932$AP_D$ and first the lower intermediate attachment location 932$AP_{I-L}$, and a second distal attachment location 934$AP_D$ and a second lower intermediate attachment location 934$AP_{I-L}$, of a second limb 934 (not illustrated), operate as hereinabove described to position attachment locations, here defined by sidewalls E in the positions to provide the desired location and shape of the loop 60. Moreover, it is important to recognize that the first distal and first lower intermediate attachment locations, 932$AP_D$ and 932$AP_{I-L}$, respectively, need not be parallel to, or in line with, or at any particular angle to, its respective first offset 932U, or 932G, (or corresponding offsets 934U or 934G from second limb 934, not shown) but any reasonably functional orientation, in either a mirror image or a mix-and-match any combination, can be utilized for advantageously controlling of the form of the bubble-forming loop 60. Stated another way, it is to be understood that a second limb 934 (not shown) may be, but need not be, of similar form and shape to first limb 932. Consequently, the respective second distal and second lower intermediate attachment locations 934$AP_D$, 934$AP_{I-L}$ of the second limb 934 need not be like shapes, or mirror images, nor even of the same nature, as those of the first limb 932; this flexibility this applies to the various embodiments of this invention as fully illustrated or reasonably foreshadowed herein.

With respect to commercial embodiments, it will be understood by those in the business of manufacturing such articles that many variations are possible. For example, an injection molded wand X30 is not limited to the form illustrated in FIG. 5, but can imitate the structure illustrated in FIG. 1. Also, although FIG. 21 depicts a first working portion 1032W offset downward by a height $H_{1032}$ by a first offset leg 1032U, the functionality is quite similar to the embodiment illustrated in FIG. 1. In both instances, an offset leg is provided so that the working portion of the wand can be dipped into the bubble solution. As shown in FIG. 21, the distal and lower intermediate attachment locations 103X$AP_D$, and 103X$AP_{I-L}$, need only position the attachment locations at a place suitable to control the form of the bubble-forming loop 60. Just as in the embodiment illustrated in FIG. 19, the first distal and first lower intermediate attachment locations 1132$AP_D$, and 1132$AP_{I-L}$ can be in any reasonable orientation, so the orientation of the first working portion 1132W need not be coplanar with the remainder of the first limb 1132, as illustrated in FIG. 22. Here, for example, the working portion 1132W is inwardly oriented and angularly positioned at a ninety (90) degree angle with respect to the downward leg 1132U.

Now, turning to FIG. 23, the embodiment of a first limb 1232 illustrated utilizes first distal and first intermediate attachment locations 1232$AP_D$, and 1232$AP_{I-L}$, defined in working portion 1232W by their respective sidewalls E as indicated, so that the attachment locations are in fact integrally provided with the working portion 1232W of the first limb 1232. Just as with the embodiment illustrated in FIG. 22, the first working portion 1232W may be in any reasonable orientation, and is not limited to being coplanar with the remainder of the first limb 1232. It is again assumed that a second limb 1234 (not shown) and is associated second working portion 1234W will be of similar form as the first limb 1232, or at least of a reasonably complementary form, from a working perspective. As noted earlier, the second limb 1234 can take on any reasonable structural shape, so need not be identical structures, or mirror images, nor even of the same structural shape, as the functional equivalent components located in the first limb 1232.

FIG. 24 illustrates a first limb 1332 incorporating a working portion 1332W, but without a downward leg between this portion 1332W and an intermediate portion 1332I. Instead, in this wand 1330, the remainder of the first limb 1332 is placed at an upward angle omega (Ω) with respect to the working portion 1332W. The downward offset of the proximal end 1332P of the working portion 1332W with respect to the upper intermediate attachment location 1332$AP_{I\text{-}U}$ permits the dipping of the collapsed loop 60 into a bubble solution container 54, in similar fashion to the wand 1430 illustrated in FIG. 25.

FIG. 25 shows wand 1430 with a first limb 1432 wherein a lower intermediate attachment location 1432$AP_{I\text{-}L}$ is extended downward by leg 1432U. However, the distal attachment location 1432$AP_D$ is without a downward leg; rather it is simply located at the distal end of the working portion 1432W of limb 1432. The wand 1432 is simply held at a downward angle to allow the loop 60 to contact the bubble solution container 54, as shown.

Generally throughout the various figures, the various attachment locations, including the distal and lower intermediate attachment locations places X3(_)$AP_D$, or X3(_) $AP_{I\text{-}L}$ (where the parenthetical blank reference numeral is normally a 2 or a 4, when utilizing the nomenclature provided herein), need not be circular or ringlike, nor need not provide a uniformly closed sidewall E in order to provide a workable attachment location for loop 60. Moreover, such attachment locations do not necessarily need to be in any specific combination or orientation. Configurations such as, but not limited to the spirals (FIG. 26), hooks (FIG. 29), clamps (FIG. 27), and clips (FIG. 28), all as illustrated in FIGS. 26 though 29, can be utilized, as well as structural and functional equivalents thereof. Even more generally, and even in the case of simple wands such as wand 730 as illustrated in FIG. 18, the attachment location can be provided by alternate structures or devices, including simple protruding knobs, cleats, depressions, as shown in FIGS. 30, 31, and 32 and/or other appropriate surfaces and/or edges in any reasonable orientation, to which the cord 60 can be attached, even with knots 78 (see FIG. 34). Additionally, adhesives or other reasonable means or fasteners, such as VELCRO loops, can be utilized to fix the absorbent-cord(s) 60 to the appropriate distal attachment location and the first lower intermediate location. A distal edge portion 80 of a bubble-forming loop 60 may even be a separate piece part from a proximal edge portion 82.

Yet another embodiment, wand 1630, is provided in FIG. 33, where a partial perspective view of a first limb 1632 is shown having a working portion 1632W which is offset downwardly at an angle omega (Ω) to the remainder of its respective limb 1632. A first working portion 1632W of the first limb 1632 can serve as a first portion 84 and a second working portion 1634W (not shown) of a second limb 1634 (not shown) serve as a second working portion 86 of a bubble-forming loop 60. Whenever such a configuration is utilized, i.e., when the working portions X(32W) or X(34W) serve as the first and second portions 84, 86 of the bubble-forming loop 60, as in this embodiment, or as in those embodiments shown in FIGS. 34, 35, and 36 it is preferred that these first and second working portions X(32W), X(34W) be textured and/or perforated to enhance the retention of the bubble-making solution 52.

Finally, still other means of defining a bubble-forming loop 60 are possible within the teachings of this disclosure. For example, FIG. 35 further illustrates an embodiment wherein a first working portion 1832$W_T$ of a first limb 1832, and a second working portion 1834W (not shown) of a second limb 1834 (not shown) are of a tubular nature, through which a flexible In absorbent-cord 40 is passed. An upwardly oriented passage 1832PC is provided in the first working portion 1832W, to accommodate the doubled cord 62 of this embodiment with an adjustable size loop 60. This passage 1832PC may be eliminated if the embodiment imitates that shown in FIG. 18, wherein the size of the loop 60 is fixed The first tubular working portion 1832W serves as the first side portion 82 of the bubble-forming loop 60, and the second tubular working portion 1832$W_T$ (not shown) of the second limb 1834 acts as the second side portion 84 of the bubble-forming loop 60. Also, the first distal end 1832$_D$ of the tubular first working portion 1832$W_T$ acts as the first distal attachment location 1832$AP_D$ and the first proximal end 1832$_{I\text{-}L}$ acts as the first lower intermediate attachment location 1832$AP_{I\text{-}L}$. The second distal end 1834$_D$ (not shown) of the tubular second working portion 1834W (not shown) acts as the second distal attachment 1834$AP_D$ and the second proximal end 1834$_{I\text{-}L}$ acts as the second lower intermediate attachment location 1834$AP_{I\text{-}L}$, thus positioning the sidewalls E (as used in this embodiment) at suitable locations to control the form of the bubble-forming loop 60.

As further shown in FIG. 36, a tubular working portion 1932$W_T$, with its associated attachment locations 1932$AP_D$ and 1932$AP_{I\text{-}L}$, may be at an angle omega (Ω) to the remainder of the respective limb, here shown as the intermediate portion 1932I of first limb 1932.

It is to be understood that a second limb X34, or any intermediate limb X33, or additional limbs, although not illustrated in FIGS. 19, 20, 21, 22, 23, 24, 25, 35, and 36, preferably would be of similar structural form as the first limb X32, such that the overall configuration is similar to the respective bubble-making wands 130, 230, 330, 430, 530, and 730 illustrated in FIGS. 5, 6, 7, 14, 15, and 18.

It is clear that the reader can understand that bubble-making wands made according to the teachings of this invention will allow young children to readily form moderate size bubbles. Importantly, those individuals of increased skill, will be capable of making a number of much larger bubbles when the adjustable loop is enlarged, using the same bubble-making wand device. The collapsible nature of the flexible loop permits the use of a long narrow-container for the bubble solution. Consequently, this type of bubble-making wand requires less bubble solution than does a rigid-circular hoop of a comparable effective diameter. The collapsible loop feature also facilitates withdrawing the loop from the bubble solution with the solution film intact, and also makes it easier to 'close off' large bubbles. These features facilitate the quick making of large diameter bubbles. In one method of use, a challenge can be created between users, to determine who can create the largest number of moderate to large bubbles (or a fewer much larger bubbles) all in the air at the same time. This can be accomplished with the present invention since the user has full control of the bubble-making plane, and can form a bubble-making loop in any orientation during the whole of the actual bubble-making process, while using only one hand. It is most significant that my novel bubble-making wand device removes bubble-making out of 'boring kiddy's play', and into the realm of real serious, and challenging 'big person's fun'.

It will thus be seen that the objects set forth above, including those made apparent from the preceding description, are efficiently attained. Since certain changes may be made in carrying out the construction of a bubble-making device according to the teachings herein, it is to be understood that my invention may be embodied in other specific forms without departing from the spirit or essential characteristics thereof. Many other embodiments are also feasible to attain advantageous results utilizing the principles disclosed herein. Therefore, it will be understood that the foregoing description of representative embodiments of the invention have been presented only for purposes of illustration and for providing an understanding of the invention, and it is not intended to be exhaustive or restrictive, or to limit the invention only to the precise forms disclosed.

All of the features disclosed in this specification (including any accompanying claims, the drawing, and the abstract) may be combined in any combination, except combinations where at least some of the features are mutually exclusive. Each feature disclosed in this specification (including any accompanying claims, the drawing, and the abstract), may be replaced by alternative structures serving the same or similar purpose, unless expressly stated otherwise. Thus, unless expressly stated otherwise, it is to be understood that each feature disclosed is but one example of a generic series of equivalent or similar features. Further, while certain materials are described for the purpose of enabling the reader to make and use certain embodiments shown, such suggestions shall not serve in any way to limit the claims to the materials disclosed, and it is to be understood that other materials, including other metals and/or various plastic compositions, may be utilized, singularly or in any suitable combination in the manufacture of my novel bubble-making devices.

The intention is to cover all modifications, equivalents, and alternatives falling within the scope and spirit of the invention, as expressed herein above and in the appended claims. As such, the claims are intended to cover the structures, apparatus, and methods described herein, and not only the equivalents or structural equivalents thereof, but also equivalent structures or methods. Thus, the scope of the invention, as described herein and as indicated by the appended claims, is intended to include variations from the embodiments provided which are nevertheless described by the broad meaning and range properly afforded to the language of the claims, as explained by and in light of the terms included herein, or the equivalents thereof.

What is claimed is:

1. A bubble-making apparatus, said apparatus comprising:

(a) a first limb, said first limb extending between a proximal end and a distal end, said first limb further comprising
  (i) a first distal attachment location;
  (ii) a first intermediate attachment location;

(b) a second limb, said second limb extending between a proximal end and a distal end, said second limb further comprising
  (i) a second distal attachment location;
  (ii) a second intermediate attachment location;

(c) a junction, said junction further comprising a manually collapsible joint mechanism biased by spring force in a normally open position, operatively joining at a resting angle alpha ($\alpha_R$) therebetween when said junction is in said normally open position:
  (i) said proximal end of said first limb, and
  (ii) said proximal end of said second limb.

2. The apparatus as set forth in claim 1, wherein:

(a) said first limb further comprises a first intermediate downwardly extending leg, and wherein said first intermediate attachment location is positioned at said first intermediate downwardly extending leg; and (b) said second limb further comprises a second intermediate downwardly extending leg, and wherein said second intermediate attachment location is positioned at said second intermediate downwardly extending leg.

3. The apparatus as set forth in claim 1, or in claim 2, wherein:

(a) said first limb further comprises a first distal downwardly extending leg, and wherein said first distal attachment location is located at said first distal downwardly extending leg; and (b) said second limb further comprises a second distal downwardly extending leg, and wherein said second distal attachment location is located at said second distal downwardly extending leg.

4. The apparatus as set forth in claim 1, or in claim 2, wherein:

(a) said first limb further comprises a first working portion wherein
  (i) said first working portion is offset downwardly by a first downwardly extending leg of height H;
  (ii) said first intermediate attachment location and said first distal attachment location are located at substantially opposing ends of said first working portion;

(b) said second limb further comprises a second working portion wherein
  (i) said second working portion is offset downwardly by a second downwardly extending leg of height H, and wherein
  (ii) said second intermediate attachment location and said second distal attachment location are located at opposing ends of said second working portion.

5. The apparatus as set forth in claim 1, wherein:

(a) said first limb further comprises (i) a first working portion, and (ii) a handle portion, and wherein said handle portion of said first limb is upwardly attached at a first angle omega (Ω) from said working portion of said first limb, and (b) said second limb further comprises (i) a second working portion, and (ii) a handle portion, and wherein said handle portion of said second-limb is upwardly attached at a second angle omega (D) from said working portion of said second limb.

6. The apparatus as set forth in claim 5, wherein on said first working portion of said first limb, said first intermediate attachment location and said first distal attachment location are located at opposing ends of said first working portion.

7. The apparatus as set forth in claim 5, wherein on said second working portion of said second limb, said second intermediate attachment location and said second distal attachment location are located at opposing ends of said second working portion.

8. The apparatus as set forth in claim 1, or in claim 2, or in claim 5, or in claim 6, or in claim 7, wherein said apparatus further comprises a flexible cord, said flexible cord detachably or permanently affixed to said apparatus by routing said cord to said first intermediate attachment location, then to said first distal attachment location, then to said second distal attachment location, then to said second intermediate attachment location, and then to said first intermediate attachment location, thereby forming a bubble-making loop.

9. The apparatus as set forth in claim 1, or in claim 2, or in claim 5, wherein said apparatus further comprises of a first flexible cord and a second flexible cord, and wherein (a) a first end of said first flexible cord is permanently or detachably affixed to said first distal attachment location, and a second end of said first flexible cord is affixed to said second distal attachment location; and (b) a first end of said second flexible cord is permanently or detachably affixed to said first intermediate attachment location, and a second end of said second flexible cord is affixed to said second intermediate attachment location.

10. The apparatus as set forth in claim 1, or claim 2, wherein said first limb further comprises a first upper intermediate attachment location.

11. The apparatus as set forth in claim 1, or in claim 2, wherein said apparatus further comprises a first proximal attachment location, said first proximal attachment location located proximally from said first intermediate attachment location.

12. The apparatus as set forth in claim 1, wherein said first limb comprises (a) a first working portion, and (b) a first hollow intermediate portion, (c) wherein said first working portion is slidably adjustable between (i) an extended, first working position, and (ii) a nested position, wherein at least some of said first working portion is slidably nested within said first hollow intermediate portion.

13. The apparatus as set forth in claim 1, wherein said second limb comprises (a) a second working portion, and (b) a second hollow intermediate portion, (c) wherein said second working portion is slidably adjustable between (i) an extended, second working position, and (ii) a nested position, wherein at least some of said second working portion is slidably nested within said second hollow intermediate portion.

14. The apparatus as set forth in claim 12, further comprising a first compression clamp, said compression clamp adapted to fixably and adjustably secure said first working portion in said first working position, or alternately in said nested position.

15. The apparatus as set forth in claim 13, further comprising a second compression clamp, said second compression clamp adapted to fixably and adjustably secure said second working portion in said second working position, or alternately in said nested position.

16. A bubble-making apparatus, said apparatus comprising:

(a) a first limb, said first limb extending between a proximal end and a distal end, said first limb further comprising (i) a first distal downwardly extending leg, said leg having located therein a first distal attachment location defined by a side wall portion;

(ii) a first intermediate downwardly extending leg, said first intermediate downwardly extending leg having located therein a first lower intermediate attachment location defined by a side wall portion;

(iii) a first intermediate upwardly extending knob, said first intermediate upwardly extending knob having located therein a first upper intermediate attachment location defined by a side wall portion;

(iv) a first proximal attachment location, said first proximal attachment location situated proximally from said first upper intermediate attachment location, said upper immediate attachment location defined by a side wall portion;

(b) a second limb, said second limb extending between a proximal end and a distal end, said second limb further comprising (i) a second distal downwardly extending leg, said leg having located therein a second distal attachment location defined by a side wall portion;

(ii) a second intermediate downwardly extending leg, said second intermediate downwardly extending leg having located therein a second lower intermediate attachment location defined by a side wall portion;

(c) a junction, said junction further comprising a manually collapsible joint mechanism biased by spring force in a normally open position, operatively joining said proximal end of said first limb and said proximal end of said second limb at a normally open angle alpha ($\alpha$).

17. The apparatus as set forth in claim 16, said apparatus further comprising a flexible cord, said flexible cord affixed to said apparatus by routing through said first lower intermediate attachment location, then through said first distal attachment location, then through said second distal attachment location, then through said second lower intermediate attachment location, and then back through said first lower intermediate attachment location, thereby forming a bubble-making loop.

18. The apparatus as set forth in claim 16, further comprising one or more intermediate limb, said one or more intermediate limb located co-planar and in-between said first and said second limbs, each one of said one or more intermediate limbs further comprising, (a) an intermediate downwardly extending distal leg, said intermediate downwardly extending distal leg further comprising an intermediate distal attachment location, and (b) an intermediate limb downwardly extending intermediate leg, said intermediate limb downwardly extending intermediate leg further comprising an intermediate limb lower intermediate attachment location.

19. The apparatus as set forth in claim 1, or in claim 16, wherein said junction comprises a spring mechanism, said spring mechanism comprising an integral, one-piece, spring joint between said first limb and said second limb, and wherein said first limb, said second limb, and said spring joint comprise an integral, one-piece apparatus.

20. The apparatus as set forth in claim 1, or in claim 16, wherein said spring-force is provided by a spring mechanism, said spring mechanism comprising a resilient, deformable elastomeric wedge.

21. The apparatus as set forth in claim 1, or in claim 16, wherein said junction further comprises a mechanical joint between said first limb and said second limb, and wherein said joint is affixed together with fasteners, thereby securing said second limb to said first limb.

22. The apparatus as set forth in claim 1, or in claim 16, wherein said junction further comprises a hinge between said first limb and said second limb.

23. The apparatus as set forth in claim 1 or in claim 16, wherein at least a portion of said first limb or said second limb comprises a tubular structure.

24. The apparatus as set forth in claim 18, wherein said junction comprises an integral, one-piece, spring joint between said first limb, said second limb, and said at least one intermediate limb.

25. The apparatus as set forth in claim 1 or in claim 16, further comprising a small hoop frame, said small hoop frame comprising at least one stem set, said small hoop frame further comprising a first set of hoops, said first set of hoops comprising a plurality of hoops affixed to a first of said at least one stem set, and wherein said small hoop frame further comprises one or more attachment clips, said one or more attachment clips adapted to secure said small hoop frame to said bubble making apparatus.

26. The apparatus as set forth in claim 25, wherein said small hoop frame further comprises two or more stem sets, and wherein said small hoop frame further comprises a plurality of small hoops affixed to each of said two or more stem sets.

27. The apparatus-as set forth in claim 26, wherein each of said two or more stem sets is sized and shaped to fit within the interior dimensions of a pre-selected bubble solution container of pre-selected length (L) and width (W).

28. A bubble-making apparatus, said apparatus comprising:

(a) a first limb, said first limb extending between a proximal end and a distal end, said first limb further comprising
  (i) a first distal downwardly extending leg, said leg having located therein a first distal attachment location;
  (ii) a first intermediate downwardly extending leg, said first intermediate downwardly extending leg having located therein a first lower intermediate attachment location;

(b) a second limb, said second limb extending between a proximal end and a distal end, said second limb further comprising
  (i) a second distal downwardly extending leg, said leg having located therein a second distal attachment location;
  (ii) a second intermediate downwardly extending leg, said second intermediate downwardly extending leg having located therein a second lower intermediate attachment location;

(c) a junction, said junction further comprising a normally open, manually collapsible joint mechanism operatively joining said proximal end of said first limb and said proximal end of said second limb at a normally open angle alpha ($\alpha$).

29. The apparatus as set forth in claim 28, said apparatus further comprising a flexible cord, said flexible cord affixed to said apparatus by routing (a) through said first lower intermediate attachment location, (b) through said first distal attachment location, (c) through said second distal attachment location, and (d) through said second lower intermediate attachment location, (e) whereby said flexible cord forms a bubble-making loop.

30. The apparatus as set forth in claim 28, wherein said junction is provided as a part of an integral, one piece spring forming joint assembly comprising (a) said first limb, (b) said second limb, and (c) said junction.

31. The apparatus as set forth in claim 30, wherein said integral one-piece spring forming joint assembly further comprises opposing handle portions.

32. A bubble-making apparatus, said apparatus comprising:

(a) a first limb, said first limb extending between a proximal end and a distal-end, said first limb further comprising a first distal attachment means and a first intermediate attachment means;

(b) a second limb, said second limb extending between a proximal end and a distal end, said second limb further comprising a second distal attachment means and a second intermediate attachment means;

(c) each of said attachment means for fixedly or detachably affixing a flexible cord to said bubble-making apparatus in a sequential fashion so as to form a bubble-making loop;

(d) a junction means, said junction means further comprising a normally open, manually collapsible joint mechanism operatively joining said first limb and said second limb at a normally open angle alpha ($\alpha$).

33. The apparatus as set forth in claim 32, wherein said junction means is a component in an integral one-piece assembly comprising (a) said junction means, (b) said first limb, and (c) said second limb.

34. The apparatus as set forth in claim 32, wherein said junction means comprises a resilient, deformable elastomeric wedge.

35. The apparatus as set forth in claim 32, wherein said first limb further comprises a first working portion, and wherein said first working portion is offset downwardly by a first downwardly extending leg, and wherein said second limb further comprises a second working portion wherein said second working portion is offset downwardly by a second downwardly extending leg.

36. The apparatus as set forth in claim 32, wherein;

(a) said first limb further comprises (i) a first working portion, and (ii) a handle portion, and wherein said handle portion of said first limb is upwardly attached at a first angle omega (n) from said working portion of said first limb, and (b) said second limb further comprises (i) a second working. portion, and (ii) a handle portion, and wherein said handle portion of said second limb is upwardly attached at a second angle omega ($\Omega$) from said working portion of said second limb.

37. The apparatus as set forth in claim 32, further comprising a first upper intermediate attachment means, said first upper intermediate attachment means adapted for adjustably receiving a portion of a flexible cord to assist in establishing the size of a preselected bubble-making loop.

38. The apparatus as set forth in claim 32, further comprising a first proximal attachment means, said first proximal attachment means adapted for adjustably receiving a portion of a flexible cord to assist in securing a preselected bubble-making loop.

39. The apparatus as set forth in claim 32, wherein said first limb comprises (a) a first working portion, and (b) a first hollow intermediate portion, (c) wherein said first working portion is slidably adjustable between
  (i) an extended, first working position, and
  (ii) a nested position, wherein at least some of said first working portion is slidably nested within said first hollow intermediate portion.

40. The apparatus as set forth in claim 32, wherein said second limb comprises (a) a second working portion, and (b) a second hollow intermediate portion, (c) wherein said second working portion is slidably adjustable between
  (i) an extended, second working position, and
  (ii) a nested position, wherein at least some of said second working portion is slidably nested within said second hollow intermediate portion.

* * * * *